US010706689B2

(12) United States Patent
Zielinski et al.

(10) Patent No.: US 10,706,689 B2
(45) Date of Patent: Jul. 7, 2020

(54) GAMING SYSTEM AND METHOD EMPLOYING MULTIPLE SYMBOL GENERATORS UTILIZED FOR MULTIPLE CONCURRENTLY PLAYED GAMES

(71) Applicant: IGT, Las Vegas, NV (US)

(72) Inventors: John H. Zielinski, Reno, NV (US); Erick Ching, Reno, NV (US); Stephanie A. Sur, Reno, NV (US); Lin Fengxing, Reno, NV (US); Boris Hallerbach, Reno, NV (US)

(73) Assignee: IGT, Las Vegas, NV (US)

( * ) Notice: Subject to any disclaimer, the term of this patent is extended or adjusted under 35 U.S.C. 154(b) by 463 days.

(21) Appl. No.: 14/497,852

(22) Filed: Sep. 26, 2014

(65) Prior Publication Data

US 2016/0093139 A1 Mar. 31, 2016

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3244* (2013.01)

(58) Field of Classification Search
CPC ..... G07F 17/34; G07F 17/326; G07F 17/3244
See application file for complete search history.

(56) References Cited

U.S. PATENT DOCUMENTS 2,077,124 A 4/1937 Miller et al.
2,545,644 A 3/1951 Benton et al.
3,633,915 A 1/1972 Lippert
3,975,022 A 8/1976 Figueroa
4,346,900 A 8/1982 Lamlee
4,410,178 A 10/1983 Partridge
4,448,419 A 5/1984 Telnaes
4,467,424 A 8/1984 Hedges et al.
4,492,378 A 1/1985 Williams
4,560,161 A 12/1985 Hamano
4,621,814 A 11/1986 Stepan et al.
4,624,459 A 11/1986 Kaufman
4,669,730 A 6/1987 Small
(Continued)

FOREIGN PATENT DOCUMENTS

AU 199716432 10/1999
EP 0797175 9/1997
(Continued)

OTHER PUBLICATIONS

Slot Machines a Pictorial History of the First 100 Years 5th edition written by Marshall Fey published 1983 to 1997.
(Continued)

*Primary Examiner* — Kang Hu
*Assistant Examiner* — Thomas H Henry
(74) *Attorney, Agent, or Firm* — Neal, Gerber & Eisenberg LLP

(57) ABSTRACT

A gaming system including a plurality of concurrent or overlapping game plays. Each concurrent or overlapping game play is associated with or otherwise configured to activate one or more symbol generators, such as one or more wheels. Following a determination of which of the games to concurrently or overlappingly play, the gaming system activates each symbol generator associated with each concurrent or overlapping game play.

28 Claims, 10 Drawing Sheets

(56) References Cited

U.S. PATENT DOCUMENTS 4,679,143 A 7/1987 Hagiwara
4,695,053 A 9/1987 Vazquez, Jr. et al.
4,710,873 A 12/1987 Breslow et al.
4,732,386 A 3/1988 Rayfiel
4,743,002 A 5/1988 Menzel
4,756,531 A 7/1988 DiRe
4,775,155 A 10/1988 Lees
4,838,552 A 6/1989 Hagiwara
4,856,787 A 8/1989 Itkis
4,874,173 A 10/1989 Kishishita
4,922,522 A 5/1990 Scanlon
4,926,327 A 5/1990 Sidley
4,941,665 A 7/1990 Klamer
4,991,848 A 2/1991 Greenwood et al.
5,019,973 A 5/1991 Wilcox et al.
5,058,893 A 10/1991 Bertram et al.
5,116,055 A 5/1992 Tracy
5,152,529 A 10/1992 Okada
5,159,549 A 10/1992 Hallman, Jr. et al.
5,178,390 A 1/1993 Okada
5,179,517 A 1/1993 Sarbin et al.
5,184,821 A 2/1993 Korenek
5,190,495 A 3/1993 Taxon
5,205,555 A 4/1993 Hamano
5,209,476 A 5/1993 Eiba
5,248,142 A 9/1993 Breeding
5,249,800 A 10/1993 Hilgendorf et al.
5,259,613 A 11/1993 Marnell, II
5,259,616 A 11/1993 Bergmann
5,275,400 A 1/1994 Weingardt et al.
5,277,424 A 1/1994 Wilms
5,288,081 A 2/1994 Breeding
5,324,035 A 6/1994 Morris et al.
5,324,041 A 6/1994 Boylan et al.
5,342,047 A 8/1994 Heidel et al.
5,344,144 A 9/1994 Canon
5,344,145 A 9/1994 Chadwick et al.
5,362,052 A 11/1994 Kubatsch
5,364,100 A 11/1994 Ludlow et al.
5,370,399 A 12/1994 Liverance
5,371,345 A 12/1994 LeStrange et al.
5,377,973 A 1/1995 Jones et al.
5,390,934 A 2/1995 Grassa
5,393,061 A 2/1995 Mansbip et al.
5,393,067 A 2/1995 Paulsen et al.
5,395,111 A 3/1995 Inoue
5,395,242 A 3/1995 Slye et al.
5,397,128 A 3/1995 Hesse et al.
5,407,200 A 4/1995 Zalabah
5,411,258 A 5/1995 Wilson et al.
5,415,416 A 5/1995 Scagnelli et al.
5,423,539 A 6/1995 Nagao
5,449,173 A 9/1995 Thomas et al.
5,450,938 A 9/1995 Rademacher
5,456,465 A 10/1995 Durham
5,470,079 A 11/1995 LeStrange et al.
5,472,194 A 12/1995 Breeding et al.
5,490,670 A 2/1996 Hobert
5,501,455 A 3/1996 Hirata et al.
5,574,888 A 6/1996 Heidel
5,536,016 A 7/1996 Thompson
5,542,669 A 8/1996 Charron et al.
5,544,892 A 8/1996 Breeding
5,553,851 A 9/1996 Malavazos et al.
5,560,603 A 10/1996 Seelig et al.
5,564,700 A 10/1996 Celona
5,569,084 A 10/1996 Nicastro et al.
5,570,885 A 11/1996 Ornstein
5,580,309 A 12/1996 Piechowiak et al.
5,584,763 A 12/1996 Kelly et al.
5,584,764 A 12/1996 Inoue
5,593,349 A 1/1997 Miguel et al.
5,609,337 A 3/1997 Clapper, Jr.
5,609,524 A 3/1997 Inoue
5,611,535 A 3/1997 Tiberio
5,611,730 A 3/1997 Weiss
5,622,366 A 4/1997 Inoue
5,639,088 A 6/1997 Schneider et al.
5,655,961 A 8/1997 Acres et al.
5,664,998 A 9/1997 Seelig et al.
5,673,917 A 10/1997 Vancura
5,674,128 A 10/1997 Holch et al.
5,697,843 A 12/1997 Manship et al.
5,704,835 A 1/1998 Dietz, II
5,707,286 A 1/1998 Carlson
5,711,525 A 1/1998 Breeding
5,722,891 A 3/1998 Inoue
5,743,526 A 4/1998 Inoue
5,752,881 A 5/1998 Inoue
5,759,103 A 6/1998 Freels et al.
5,761,647 A 6/1998 Boushy
5,769,716 A 6/1998 Saffari et al.
5,770,533 A 6/1998 Franchi
5,772,509 A 6/1998 Weiss
5,775,692 A 7/1998 Watts et al.
5,788,230 A 8/1998 Krise et al.
5,788,573 A 8/1998 Baerlocher et al.
5,788,574 A 8/1998 Ornstein et al.
5,816,915 A 10/1998 Kadlik
5,823,872 A 10/1998 Prather et al.
5,823,874 A 10/1998 Adams et al.
D400,597 S 11/1998 Hedrick et al.
5,839,730 A 11/1998 Pike
D402,702 S 12/1998 Seelig et al.
5,848,932 A 12/1998 Adams
5,851,148 A 12/1998 Brune et al.
5,863,249 A 1/1999 Inoue
5,873,781 A 2/1999 Keane
D406,865 S 3/1999 Heidel
5,882,261 A 3/1999 Adams
5,885,157 A 3/1999 Harada et al.
5,890,962 A 4/1999 Takemoto
5,911,418 A 6/1999 Adams et al.
5,919,088 A 7/1999 Weiss
5,919,091 A 7/1999 Bell et al.
5,927,714 A 7/1999 Kaplan
5,934,999 A 8/1999 Valdez
5,935,002 A 8/1999 Falciglia
5,947,820 A 9/1999 Morro et al.
5,947,821 A 9/1999 Stone
5,951,397 A 9/1999 Dickinson
5,964,463 A 10/1999 Moore, Jr.
5,967,896 A 10/1999 Jorach et al.
5,976,015 A 11/1999 Seelig et al.
5,980,384 A 11/1999 Barrie
5,984,779 A 11/1999 Bridgeman et al.
5,984,781 A 11/1999 Sunaga
5,984,782 A 11/1999 Inoue
5,988,643 A 11/1999 Awada
5,989,121 A 11/1999 Sakamoto
5,997,401 A 12/1999 Crawford
6,001,016 A 12/1999 Walker et al.
6,004,207 A 12/1999 Wilson, Jr. et al.
6,012,982 A 1/2000 Piechowiak et al.
6,015,346 A 1/2000 Bennett
6,019,374 A 2/2000 Breeding
6,024,642 A 2/2000 Stupak
6,033,307 A 3/2000 Vancura
6,039,648 A 3/2000 Guinn et al.
6,047,963 A 4/2000 Pierce et al.
6,056,641 A 5/2000 Webb
6,056,642 A 5/2000 Bennett
6,059,289 A 5/2000 Vancura
6,059,658 A 5/2000 Mangano et al.
6,062,979 A 5/2000 Inoue
6,062,980 A 5/2000 Luciano
6,068,552 A 5/2000 Walker et al.
6,077,162 A 6/2000 Weiss
6,086,066 A 7/2000 Takeuchi et al.
6,089,976 A 7/2000 Schneider et al.
6,089,977 A 7/2000 Bennett
6,089,978 A 7/2000 Adams
6,093,102 A 7/2000 Bennett
6,102,400 A 8/2000 Scott et al.

(56) References Cited

U.S. PATENT DOCUMENTS 6,102,798 A 8/2000 Bennett
6,105,962 A 8/2000 Malavazos et al.
6,113,098 A 9/2000 Adams
6,120,031 A 9/2000 Adams
6,120,377 A 9/2000 McGinnis, Sr. et al.
6,126,542 A 10/2000 Fier
6,129,355 A 10/2000 Hahn et al.
6,135,884 A 10/2000 Hedrick et al.
6,142,873 A 11/2000 Weiss et al.
6,142,874 A 11/2000 Kodachi et al.
6,146,273 A 11/2000 Olsen
6,149,157 A 11/2000 Saun
6,149,522 A 11/2000 Alcorn et al.
6,159,095 A 12/2000 Frohm et al.
6,159,097 A 12/2000 Gura
6,159,098 A 12/2000 Slomiany et al.
6,162,121 A 12/2000 Morro et al.
6,164,652 A 12/2000 Lauretta et al.
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,179,710 B1 1/2001 Sawyer et al.
6,186,894 B1 2/2001 Mayeroff
6,190,254 B1 2/2001 Bennett
6,190,255 B1 2/2001 Thomas et al.
6,200,217 B1 3/2001 Osawa
6,203,427 B1 3/2001 Walker et al.
6,203,429 B1 3/2001 Demar et al.
D441,031 S 4/2001 Seelig et al.
6,210,275 B1 4/2001 Olsen
6,210,279 B1 4/2001 Dickinson
6,213,876 B1 4/2001 Moore, Jr.
6,217,022 B1 4/2001 Astaneha
6,220,593 B1 4/2001 Pierce et al.
6,224,483 B1 5/2001 Mayeroff
6,227,969 B1 5/2001 Yoseloff
6,227,970 B1 5/2001 Shimizu et al.
6,227,971 B1 5/2001 Weiss
6,227,972 B1 5/2001 Walker et al.
6,231,442 B1 5/2001 Mayeroff
6,234,897 B1 5/2001 Frohm et al.
6,234,900 B1 5/2001 Cumbers
D443,313 S 6/2001 Brettschneider
6,251,013 B1 6/2001 Bennett
6,254,481 B1 7/2001 Jaffe
6,261,177 B1 7/2001 Bennett
6,264,561 B1 7/2001 Saffari et al.
6,267,669 B1 7/2001 Luciano, Jr. et al.
6,270,411 B1 8/2001 Gura et al.
6,270,412 B1 8/2001 Crawford et al.
6,283,855 B1 9/2001 Bingham
6,290,600 B1 9/2001 Glasson
6,299,165 B1 10/2001 Nagano
6,302,790 B1 10/2001 Brossard
6,305,686 B1 10/2001 Perrie et al.
6,309,300 B1 10/2001 Glavich
6,312,334 B1 11/2001 Yoseloff
6,315,663 B1 11/2001 Sakamoto
6,315,664 B1 11/2001 Baerlocher et al.
6,315,666 B1 11/2001 Mastera et al.
6,319,123 B1 11/2001 Paludi
6,319,125 B1 11/2001 Acres
6,328,649 B1 12/2001 Randall et al.
6,334,814 B1 1/2002 Adams
6,336,857 B1 1/2002 McBride
6,336,860 B1 1/2002 Webb
6,336,863 B1 1/2002 Baerlocher et al.
6,338,678 B1 1/2002 Seelig et al.
6,340,158 B2 1/2002 Pierce et al.
6,346,043 B1 2/2002 Colin et al.
6,347,795 B1 2/2002 DeLeljer
6,347,996 B1 2/2002 Gilmore et al.
6,361,441 B1 3/2002 Walker et al.
6,364,766 B1 4/2002 Anderson et al.
6,364,767 B1 4/2002 Brossard et al.
6,368,216 B1 4/2002 Hedrick et al.
6,375,187 B1 4/2002 Baerlocher
6,379,248 B1 4/2002 Jorasch et al.
6,386,974 B1 5/2002 Adams
6,394,907 B1 5/2002 Rowe
6,398,218 B1 6/2002 Vancura
6,398,220 B1 6/2002 Inoue
6,398,644 B1 6/2002 Perrie et al.
6,398,645 B1 6/2002 Yoseloff
6,398,651 B1 6/2002 Yamada
6,406,369 B1 6/2002 Baerlocher et al.
6,413,160 B1 7/2002 Vancura
6,413,162 B1 7/2002 Baerlocher et al.
6,419,579 B1 7/2002 Bennett et al.
6,425,823 B1 7/2002 Byrne
6,428,412 B1 8/2002 Anderson et al.
6,431,983 B2 8/2002 Acres
6,439,995 B1 8/2002 Hughs Baird et al.
6,443,837 B1 9/2002 Jaffe et al.
6,443,841 B1 9/2002 Rossides
6,450,884 B1 9/2002 Seelig et al.
6,454,651 B1 9/2002 Yoseloft
6,461,241 B1 10/2002 Webb et al.
6,464,582 B1 10/2002 Baerlocher et al.
D465,531 S 11/2002 Luciano, Jr. et al.
6,481,713 B2 11/2002 Perrie et al.
6,482,089 B2 11/2002 Demar et al.
6,491,584 B2 12/2002 Graham et al.
6,494,454 B2 12/2002 Adams
6,506,117 B2 1/2003 DeMar et al.
6,508,707 B2 1/2003 DeMar et al.
6,517,073 B1 2/2003 Vancura
6,523,829 B1 2/2003 Walker et al.
6,533,660 B2 3/2003 Seelig et al.
6,536,766 B1 3/2003 Deitch et al.
6,537,152 B2 3/2003 Seelig et al.
6,549,912 B1 4/2003 Chen
6,554,709 B1 4/2003 Brenner et al.
6,558,255 B2 5/2003 Walker
6,561,512 B2 5/2003 Luciano
6,561,904 B2 5/2003 Locke et al.
6,565,436 B1 5/2003 Baerlocher
6,569,015 B1 * 5/2003 Baerlocher ..... G07F 17/32 273/143 R
6,569,016 B1 5/2003 Baerlocher
6,579,179 B2 6/2003 Poole et al.
6,582,306 B1 6/2003 Kaminkow
6,582,307 B2 6/2003 Webb
6,595,855 B2 7/2003 Sako
6,599,185 B1 7/2003 Kaminkow et al.
6,602,135 B1 8/2003 Gerrard
6,602,137 B2 8/2003 Kaminkow et al.
6,605,000 B2 8/2003 Adams
6,607,195 B2 8/2003 Vancura
6,607,437 B2 8/2003 Casey et al.
6,607,441 B1 8/2003 Acres
6,609,972 B2 8/2003 Seelig et al.
6,634,943 B1 10/2003 Baerlocher
6,644,664 B2 11/2003 Muir et al.
6,645,071 B2 11/2003 Perrie et al.
6,648,759 B2 11/2003 Vancura
6,652,378 B2 11/2003 Cannon et al.
6,656,040 B1 12/2003 Brosnan et al.
6,659,863 B2 12/2003 Ashley et al.
6,663,489 B2 12/2003 Baerlocher
6,679,497 B2 1/2004 Walker et al.
6,682,420 B2 1/2004 Webb et al.
6,685,567 B2 2/2004 Cockerille et al.
6,692,003 B2 2/2004 Potter et al.
6,692,355 B2 2/2004 Baerlocher et al.
6,702,289 B1 3/2004 Feola
6,705,944 B2 3/2004 Luciano
6,712,693 B1 3/2004 Hettinger
6,712,694 B1 3/2004 Nordman
6,715,756 B2 4/2004 Inoue
6,722,985 B2 4/2004 Criss-Puszkiewiez et al.
6,726,565 B2 4/2004 Hughs-Baird
6,729,955 B2 5/2004 Bennett et al.

(56) References Cited

U.S. PATENT DOCUMENTS 6,749,502 B2 6/2004 Baerlocher
6,769,987 B1 8/2004 Morita et al.
6,780,111 B2 8/2004 Cannon et al.
6,786,819 B2 9/2004 Baerlocher et al.
6,789,801 B2 9/2004 Snow
6,793,577 B1 9/2004 Wilkins et al.
6,804,763 B1 10/2004 Stockciale et al.
6,827,646 B2 12/2004 Adams
6,832,957 B2 12/2004 Falconer
6,835,132 B2 12/2004 Bennett
6,835,134 B2 12/2004 Poole et al.
6,837,788 B2 1/2005 Cannon
6,855,052 B2 2/2005 Weiss et al.
6,855,056 B2 2/2005 Inoue
6,860,810 B2 3/2005 Cannon et al.
6,863,608 B1 3/2005 LeMay et al.
6,866,586 B2 3/2005 Oberberger et al.
D503,951 S 4/2005 Karstens
6,884,165 B2 4/2005 Baerlocher
6,890,255 B2 5/2005 Jarvis et al.
6,899,620 B2 5/2005 Kaminkow et al.
6,905,405 B2 6/2005 McClintic
6,905,407 B2 * 6/2005 Nordman ..... G07F 17/3211 273/138.2
D512,464 S 12/2005 Karstens
D512,465 S 12/2005 Karstens
6,974,129 B2 12/2005 Nordman
6,981,917 B2 1/2006 Webb et al.
6,986,709 B2 1/2006 Hughs-Baird et al.
6,988,731 B2 1/2006 Inoue
6,991,538 B2 1/2006 Cannon
6,997,805 B2 2/2006 Vancura
7,004,835 B2 2/2006 Baerlocher
7,029,395 B1 4/2006 Baerlocher
7,040,983 B2 5/2006 Dolloff et al.
7,056,209 B2 6/2006 Baerlocher et al.
7,059,967 B2 6/2006 Baerlocher
7,111,845 B2 9/2006 Walker et al.
7,121,943 B2 10/2006 Webb et al.
7,128,646 B2 10/2006 Baerlocher et al.
7,131,908 B2 11/2006 Baerlocher
7,156,735 B2 1/2007 Brosnan et al.
7,160,188 B2 1/2007 Kaminkow et al.
7,179,169 B2 2/2007 Beaulieu et al.
7,201,654 B1 4/2007 Jarvis et al.
7,204,754 B2 4/2007 Gray et al.
RE39,659 E * 5/2007 Luciano, Jr. ..... 273/138.2
7,226,358 B2 6/2007 Miller et al.
7,235,011 B2 6/2007 Randall et al.
D552,121 S 10/2007 Carl et al.
7,278,919 B2 10/2007 Souza et al.
7,294,055 B2 11/2007 Baerlocher et al.
7,297,059 B2 11/2007 Vancura et al.
7,311,605 B2 12/2007 Moser
7,329,179 B2 2/2008 Baerlocher
D563,977 S 3/2008 Carl et al.
7,341,512 B2 3/2008 Dolloff et al.
7,341,518 B2 3/2008 Muskin
7,351,146 B2 4/2008 Kaminkow
7,361,088 B2 4/2008 Maya
7,371,174 B2 5/2008 Baerlocher
7,399,226 B2 7/2008 Mishra
7,399,228 B2 7/2008 Baerlocher
7,425,177 B2 9/2008 Rodgers et al.
7,427,236 B2 9/2008 Kaminkow et al.
7,431,644 B2 10/2008 Moody
7,442,123 B2 10/2008 Brill et al.
7,455,585 B2 11/2008 Englman
7,488,248 B2 2/2009 Hughs-Baird et al.
D591,305 S 4/2009 Shimoda
7,513,827 B2 4/2009 Baerlocher
7,513,828 B2 4/2009 Nguyen et al.
7,547,252 B2 6/2009 Peterson et al.
7,575,514 B2 8/2009 Cuddy et al.
D601,156 S 9/2009 Motohashi
7,591,723 B2 9/2009 Cregan et al.
7,594,851 B2 9/2009 Falconer
7,597,618 B2 10/2009 Webb et al.
7,611,411 B2 11/2009 Griswold et al.
7,614,947 B2 11/2009 Baerlocher et al.
7,614,952 B2 11/2009 Elias
7,617,151 B2 11/2009 Rowe
7,625,278 B2 12/2009 Paulsen et al.
7,674,172 B2 3/2010 Miltenberger et al.
D614,192 S 4/2010 Takano et al.
7,690,978 B2 4/2010 Webb et al.
7,692,635 B2 4/2010 Iwamura
7,708,628 B2 5/2010 Baerlocher
7,708,630 B2 5/2010 Nicely
7,731,584 B2 6/2010 Glavich et al.
7,740,535 B2 6/2010 Kido
7,758,417 B2 7/2010 Jorasch et al.
7,771,268 B2 8/2010 Mayeroff
7,780,517 B2 8/2010 Saffari et al.
7,780,520 B2 8/2010 Baerlocher
7,785,185 B2 * 8/2010 Webb ..... G07F 17/32 273/138.1
7,792,920 B2 9/2010 Istvan et al.
7,794,317 B2 9/2010 Kaminkow et al.
7,806,760 B2 10/2010 Baerlocher
7,806,764 B2 10/2010 Brosnan et al.
7,815,503 B2 10/2010 Walker et al.
7,850,171 B2 12/2010 Bontempo et al.
7,850,522 B2 12/2010 Walker et al.
7,867,080 B2 1/2011 Nicely et al.
7,871,323 B2 1/2011 Walker et al.
7,874,904 B2 1/2011 Randall
7,901,294 B2 3/2011 Walker et al.
7,914,373 B2 3/2011 Webb et al.
7,977,212 B2 4/2011 Hedrick et al.
7,988,549 B2 8/2011 Little
7,988,551 B2 8/2011 Walker et al.
8,016,657 B2 9/2011 Walker et al.
8,016,679 B2 9/2011 Steil et al.
8,100,754 B2 1/2012 Bigelow, Jr. et al.
8,109,821 B2 2/2012 Kovacs et al.
8,128,492 B2 3/2012 Vasquez et al.
8,151,209 B2 4/2012 Law et al.
8,157,633 B2 4/2012 Kaminkow
8,210,944 B2 7/2012 Mead
8,235,781 B2 8/2012 Moody
8,246,443 B2 8/2012 Randall
8,246,445 B2 8/2012 Rodgers et al.
D667,430 S 9/2012 Ouilhet et al.
8,262,458 B2 9/2012 Rodgers et al.
8,308,547 B2 11/2012 Walker et al.
D672,784 S 12/2012 Clanton et al.
8,333,657 B1 12/2012 Nelson et al.
8,342,941 B2 1/2013 Nicely
8,403,740 B2 3/2013 Kovacs et al.
8,408,990 B2 4/2013 De Waal et al.
D681,662 S 5/2013 Fletcher et al.
8,449,390 B2 5/2013 Kaminkow
D684,587 S 6/2013 Plesnicher et al.
8,460,084 B2 6/2013 Kaminkow et al.
8,475,261 B2 7/2013 Little
8,500,551 B2 8/2013 Baerlocher et al.
8,512,120 B2 8/2013 Nelson et al.
D690,318 S 9/2013 Kluttz et al.
8,622,803 B2 * 1/2014 Cuddy ..... G07F 17/3211 273/138.1
8,622,808 B2 * 1/2014 Pececnik ..... G07F 17/3202 463/16
D699,747 S 2/2014 Pearson et al.
D700,618 S 3/2014 Hwang et al.
D701,226 S 3/2014 Jung
8,672,750 B2 3/2014 Nelson et al.
D713,411 S 9/2014 Gall et al.
D713,412 S 9/2014 Gall et al.
D714,341 S 9/2014 Daniel
D719,180 S 12/2014 Liang
8,951,116 B1 * 2/2015 Koenig ..... G07F 17/3213 463/16
D723,582 S 3/2015 Green et al.

(56) References Cited

U.S. PATENT DOCUMENTS

D729,260 S 5/2015 Ahn et al.
D730,935 S 6/2015 Franganillo et al.
D732,566 S 6/2015 Mitchell et al.
D737,301 S 8/2015 Hisada et al.
D739,861 S 9/2015 Perez et al.
D740,308 S 10/2015 Kim et al.
D742,898 S 11/2015 Matas et al.
D745,533 S 12/2015 Luo
D748,126 S 1/2016 Sarukkai et al.
D750,123 S 2/2016 Subramanian et al.
D751,574 S 3/2016 Forsblom
D751,595 S 3/2016 Cho et al.
D752,060 S 3/2016 Kim et al.
D752,061 S 3/2016 Ahn et al.
D752,619 S 3/2016 Cho et al.
D753,685 S 4/2016 Zimmerman et al.
D754,674 S 4/2016 Lee
D754,686 S 4/2016 Mandeville
D755,798 S 5/2016 Zheng
D759,070 S 6/2016 Heeter et al.
D759,077 S 6/2016 Bergmann et al.
D759,079 S 6/2016 Carlton et al.
D759,080 S 6/2016 Luo et al.
9,659,430 B2 * 5/2017 Nicely ..... G07F 17/3211
2001/0024971 A1 9/2001 Brossard
2001/0049298 A1 12/2001 Bennett
2002/0004424 A1 1/2002 Nelson et al.
2002/0010018 A1 1/2002 Lemay et al.
2002/0025846 A1 2/2002 Bennett et al.
2002/0025849 A1 2/2002 Olive
2002/0025850 A1 2/2002 Hafezi
2002/0039918 A1 4/2002 Anderson et al.
2002/0042294 A1 * 4/2002 Pau ..... G07F 17/3262 463/16
2002/0077167 A1 6/2002 Merari
2002/0094862 A1 7/2002 Inoue
2002/0137559 A1 9/2002 Baerlocher
2002/0142829 A1 10/2002 Inoue
2003/0027628 A1 2/2003 Luciano
2003/0036420 A1 2/2003 Baerlocher et al.
2003/0040355 A1 2/2003 Baerlocher
2003/0040358 A1 2/2003 Rothkranz et al.
2003/0045338 A1 3/2003 Dolloff et al.
2003/0064773 A1 4/2003 Baerlocher et al.
2003/0064790 A1 4/2003 Hughs-Baird et al.
2003/0073497 A1 4/2003 Nelson
2003/0078089 A1 4/2003 Gray et al.
2003/0137110 A1 7/2003 Huard et al.
2003/0144053 A1 7/2003 Michaelson
2003/0178768 A1 9/2003 Luciano et al.
2003/0181239 A1 9/2003 Walker et al.
2003/0195027 A1 10/2003 Baerlocher et al.
2003/0199311 A1 10/2003 Webb
2003/0203756 A1 10/2003 Jackson
2003/0222401 A1 12/2003 Kaminkow
2003/0232643 A1 12/2003 Inoue
2004/0000754 A1 1/2004 Inoue
2004/0002372 A1 1/2004 Rodgers et al.
2004/0002373 A1 1/2004 Kaminkow
2004/0002379 A1 1/2004 Parrott et al.
2004/0005919 A1 1/2004 Walker et al.
2004/0009807 A1 1/2004 Miller et al.
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0026854 A1 2/2004 Inoue
2004/0036218 A1 2/2004 Inoue
2004/0038726 A1 2/2004 Inoue
2004/0038734 A1 2/2004 Adams
2004/0041340 A1 3/2004 Inoue
2004/0043811 A1 * 3/2004 Seelig ..... G07F 17/3244 463/16
2004/0043815 A1 3/2004 Kaminkow
2004/0048645 A1 3/2004 Webb et al.
2004/0048649 A1 3/2004 Peterson et al.
2004/0048673 A1 3/2004 Kaminkow
2004/0053658 A1 3/2004 Rothranz
2004/0053659 A1 3/2004 Rothkranz et al.
2004/0053660 A1 3/2004 Webb et al.
2004/0053663 A1 3/2004 Paulsen et al.
2004/0053665 A1 * 3/2004 Baerlocher ..... G07F 17/3267 463/16
2004/0053670 A1 3/2004 Rothkranz et al.
2004/0053671 A1 3/2004 Nordman
2004/0053687 A1 3/2004 Nordman et al.
2004/0063492 A1 4/2004 Baerlocher et al.
2004/0070146 A1 4/2004 Snow
2004/0077403 A1 4/2004 Maya et al.
2004/0082378 A1 4/2004 Peterson et al.
2004/0084843 A1 5/2004 Snow
2004/0087369 A1 5/2004 Tanaka et al.
2004/0090003 A1 5/2004 Snow
2004/0090005 A1 5/2004 Snow
2004/0097282 A1 * 5/2004 Baerlocher ..... G07F 17/3293 463/16
2004/0106446 A1 6/2004 Cannon et al.
2004/0121838 A1 6/2004 Hughs-Baird et al.
2004/0121840 A1 6/2004 Rosander et al.
2004/0147306 A1 7/2004 Randall et al.
2004/0147314 A1 7/2004 LeMay et al.
2004/0150161 A1 8/2004 Inoue
2004/0152498 A1 8/2004 Kaminkow et al.
2004/0152509 A1 8/2004 Hornik et al.
2004/0155399 A1 8/2004 Inoue
2004/0157658 A1 8/2004 Rothkranz
2004/0171417 A1 9/2004 Beaulieu et al.
2004/0171419 A1 9/2004 Walker et al.
2004/0171423 A1 9/2004 Silva et al.
2004/0180715 A1 9/2004 Nordman
2004/0183251 A1 9/2004 Inoue
2004/0192431 A1 9/2004 Singer et al.
2004/0219968 A1 11/2004 Fiden et al.
2005/0014562 A1 1/2005 Fujimoto
2005/0054412 A1 3/2005 Gauselmann
2005/0054431 A1 3/2005 Walker et al.
2005/0059455 A1 3/2005 Gerrard et al.
2005/0070353 A1 * 3/2005 Webb ..... G07F 17/32 463/16
2005/0075159 A1 * 4/2005 Kaminkow ..... G07F 17/32 463/16
2005/0085288 A1 4/2005 Schugar et al.
2005/0107158 A1 5/2005 Kanisawa et al.
2005/0153778 A1 7/2005 Nelson et al.
2005/0192099 A1 9/2005 Nguyen et al.
2005/0233794 A1 10/2005 Cannon et al.
2005/0233803 A1 10/2005 Yang
2005/0239542 A1 10/2005 Olsen
2006/0025200 A1 2/2006 Van Asdale
2006/0035707 A1 2/2006 Nguyen et al.
2006/0040732 A1 2/2006 Baerlocher et al.
2006/0046823 A1 3/2006 Kaminkow et al.
2006/0073867 A1 4/2006 Rothkranz
2006/0073873 A1 * 4/2006 Rodgers ..... G07F 17/34 463/20
2006/0073882 A1 4/2006 Rozkin et al.
2006/0073884 A1 4/2006 Walker et al.
2006/0080408 A1 4/2006 Istvan et al.
2006/0092019 A1 5/2006 Fallon
2006/0128457 A1 6/2006 Cannon
2006/0148547 A1 7/2006 Montgomery et al.
2006/0154722 A1 7/2006 Walker et al.
2006/0178191 A1 * 8/2006 Ellis ..... A63F 5/00 463/17
2006/0189364 A1 8/2006 Baerlocher
2006/0211473 A1 9/2006 Walker et al.
2006/0237905 A1 10/2006 Nicely
2006/0247010 A1 11/2006 Gagner
2006/0252508 A1 11/2006 Walker et al.
2006/0252546 A1 11/2006 Castellari et al.
2007/0054726 A1 3/2007 Muir et al.
2007/0060314 A1 3/2007 Baerlocher et al.
2007/0060321 A1 3/2007 Vasquez et al.

(56) References Cited

U.S. PATENT DOCUMENTS

| | | | | |
|---|---|---|---|---|
| 2007/0102877 | A1 | 5/2007 | Personius et al. | |
| 2007/0129131 | A1 | 6/2007 | Kaminkow et al. | |
| 2007/0155482 | A1 | 7/2007 | Walker et al. | |
| 2007/0155483 | A1 | 7/2007 | Walker et al. | |
| 2007/0155484 | A1 | 7/2007 | Walker et al. | |
| 2007/0178972 | A1 | 8/2007 | Moshal | |
| 2007/0191088 | A1 | 8/2007 | Breckner et al. | |
| 2007/0202941 | A1 | 8/2007 | Miltenberger et al. | |
| 2007/0243925 | A1 | 10/2007 | LeMay et al. | |
| 2007/0265094 | A1 | 11/2007 | Tone et al. | |
| 2007/0273097 | A1 | 11/2007 | Kirkutis | |
| 2007/0275777 | A1 | 11/2007 | Walker et al. | |
| 2007/0293293 | A1 | 12/2007 | Baerlocher et al. | |
| 2007/0293306 | A1 | 12/2007 | Nee et al. | |
| 2008/0009334 | A1 | 1/2008 | Walker et al. | |
| 2008/0067745 | A1 | 3/2008 | Wikstrom | |
| 2008/0076496 | A1 | 3/2008 | Baerlocher et al. | |
| 2008/0076531 | A1 | 3/2008 | Baerlocher et al. | |
| 2008/0076532 | A1 | 3/2008 | Graham et al. | |
| 2008/0076542 | A1 | 3/2008 | Iddings et al. | |
| 2008/0102934 | A1 | 5/2008 | Tan | |
| 2008/0108425 | A1 | 5/2008 | Oberberger | |
| 2008/0146344 | A1 | 6/2008 | Rowe et al. | |
| 2008/0176635 | A1 | 7/2008 | Randall | |
| 2008/0182650 | A1 | 7/2008 | Randall et al. | |
| 2009/0098933 | A1 | 4/2009 | Walker et al. | |
| 2009/0111574 | A1 | 4/2009 | Rowe | |
| 2009/0203422 | A1 | 8/2009 | Ellis | |
| 2009/0209333 | A1 | 8/2009 | Kelly et al. | |
| 2010/0016062 | A1 | 1/2010 | Baerlocher | |
| 2010/0120506 | A1 | 5/2010 | Davis et al. | |
| 2010/0151937 | A1 | 6/2010 | Tallal, Jr. | |
| 2010/0197394 | A1 | 8/2010 | Imachi et al. | |
| 2010/0210353 | A1 | 8/2010 | Gagner et al. | |
| 2010/0210364 | A1 | 8/2010 | York et al. | |
| 2010/0248821 | A1 | 9/2010 | Jorasch et al. | |
| 2011/0045892 | A1 | 2/2011 | Vann et al. | |
| 2011/0111842 | A1 | 5/2011 | Walker et al. | |
| 2011/0218027 | A1* | 9/2011 | Manz | A63F 9/24 463/19 |
| 2012/0202592 | A1 | 8/2012 | Sprinkle | |
| 2013/0059638 | A1 | 3/2013 | Nicely | |
| 2013/0059647 | A1* | 3/2013 | Nicely | G07F 17/326 463/25 |
| 2013/0079116 | A1 | 3/2013 | Nelson et al. | |
| 2013/0084937 | A1* | 4/2013 | Vann | G07F 17/3244 463/20 |
| 2013/0316781 | A1* | 11/2013 | Pececnik | G07F 17/3202 463/17 |
| 2015/0082162 | A1 | 3/2015 | Cho et al. | |
| 2015/0302700 | A1* | 10/2015 | Zielinski | G07F 17/3227 463/20 |

FOREIGN PATENT DOCUMENTS

| | | |
|---|---|---|
| GB | 2084371 | 9/1980 |
| GB | 2100905 | 6/1981 |
| GB | 2066991 | 7/1981 |
| GB | 2106293 | 9/1981 |
| GB | 2090690 | 7/1982 |
| GB | 2096376 | 10/1982 |
| GB | 2098778 | 11/1982 |
| GB | 2105891 | 3/1983 |
| GB | 2137392 | 10/1984 |
| GB | 2144644 | 3/1985 |
| GB | 2153572 | 8/1985 |
| GB | 2161008 | 1/1986 |
| GB | 2170636 | 8/1986 |
| GB | 2180682 | 4/1987 |
| GB | 2181589 | 4/1987 |
| GB | 2183882 | 6/1987 |
| GB | 2191030 | 12/1987 |
| GB | 2201821 | 9/1988 |
| GB | 2222712 | 3/1990 |
| GB | 2225889 | 6/1990 |
| GB | 2242300 | 9/1991 |
| GB | 2322217 | 8/1998 |
| WO | WO1996/009102 | 3/1996 |
| WO | WO1999/010849 | 3/1999 |
| WO | WO2000/012186 | 3/2000 |
| WO | WO2000/032286 | 6/2000 |
| WO | WO2001/082245 | 1/2001 |
| WO | WO2002/099760 | 12/2002 |
| WO | WO/2003/011409 | 2/2003 |
| WO | WO2005/079242 | 9/2005 |

OTHER PUBLICATIONS

Slot Machines on Parade written by Robert N. Geddes Illustrated by Daniel R. Mead published 1980.

Aristocrat Technologies Wonder 4 Game Feature published by Innovate Gaming in 2014.

Australian Examination Report No. 1 for Application No. 2015224500 dated Feb. 21, 2020 (4 pages).

* cited by examiner

GAMING SYSTEM AND METHOD EMPLOYING MULTIPLE SYMBOL GENERATORS UTILIZED FOR MULTIPLE CONCURRENTLY PLAYED GAMES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate a primary or base game, such as a primary reel game. Certain known gaming machines enable a player to wager on and play a plurality of primary or base games simultaneously or concurrently. In many of these gaming machines, the award for each played primary game is based on the player obtaining a winning symbol or symbol combination on a plurality of reels and on the amount of the wager placed on that primary game (e.g., the higher the wager, the higher the award). Generally, symbols or symbol combinations which are less likely to occur usually provide higher awards.

Various known gaming machines enable players to play more than one wagering game simultaneously. Certain of these gaming machines enable players to play multiple plays of a same wagering game simultaneously, plays of different wagering games simultaneously, or both.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

One known type of bonus game employs a wheel including several awards. In one such bonus game, a multi-colored award wheel is attached to the cabinet of the gaming device. The award wheel is divided into several sections. Each section includes an award that ranges in value, such as from twenty-five to one-thousand. In such a bonus game, the player obtains one opportunity or spin of the award wheel. The player spins the award wheel by pressing a button on the gaming device. Once the award wheel starts spinning, the player waits until it stops. An indicator located at the top of the award wheel points to a section of the wheel. The player receives the award on the indicated section for the bonus game. After the player receives that award, the bonus game ends and the player may resume playing the base game.

There is a continuing need to provide new and different gaming systems and methods which utilize one or more wheels. There is also a continuing need to provide new and different gaming systems and methods which incorporate new and different ways to play multiple games concurrently.

SUMMARY

The present disclosure relates generally to gaming systems and methods employing multiple symbol generators for multiple concurrently played games.

In various embodiments, the gaming system disclosed herein includes a plurality of concurrent or overlapping game plays. Each concurrent or overlapping game play is associated with or otherwise configured to activate one or more symbol generators, such as one or more wheels. In these embodiments, following a determination of which of the games to concurrently or overlappingly play, such as following a placement of a wager on one or more of the games, the gaming system activates each symbol generator associated with each concurrent or overlapping game play. The gaming system causes each activated symbol generator to generate an outcome, such as an award value, a bonus game trigger or a losing outcome. In certain embodiments, the gaming system additionally selects one of the generated outcomes and modifies that generated outcome by a randomly determined modifier. In these embodiments, for each of the concurrently or overlappingly played games, the gaming system determines an award for that played game, wherein the award is based on the generated outcome or modified outcome of the activated symbol generator of that concurrently or overlappingly played game. Such a configuration of concurrently or overlappingly generating outcomes for a plurality of independently operated symbol generators utilized amongst a plurality of different concurrently or overlappingly played games increases the level of excitement and enjoyment for certain players by increasing the quantity of award opportunities for such players.

In operation of various embodiments, upon an occurrence of a concurrent or overlapping game play triggering event, such as a player placing a wager on one, more or each of a plurality of available games, the gaming system triggers a plurality of concurrent or overlapping game plays. In these embodiments, each of the games is associated with an independent or distinct symbol generator. For each of the triggered concurrent or overlapping game plays, the gaming system activates the symbol generator(s) associated with that game. For each activated symbol generator associated with each concurrent or overlapping game play, the gaming system randomly determines an outcome. The gaming system then determines an award for each concurrent or overlapping game play based on the outcome randomly determined by the activated symbol generator(s) associated with that concurrent or overlapping game play. Such a configuration of employing a plurality of independently operable symbol generators in association with a plurality of simultaneous or overlappingly game plays benefits players by providing greater awards to such players and thus increases the excitement and enjoyment for the player.

In certain example embodiments, each of the plurality of games of the gaming system disclosed herein employs or is otherwise associated with a separate wheel. Each wheel has a plurality of sections, slices or wedges. Each section of each wheel displays zero, one or more symbols. Such symbols are associated with one of a plurality of awards, such as values, modifiers, game play functions or bonus game triggers. Each wheel is also associated one or more indicators or pointers.

In different example embodiments, the quantity of sections of one or more wheels, the size of one or more sections of one or more wheels and/or the quantity of pointers of one or more wheels vary from wheel to wheel. In certain embodiments, the quantity of sections of one or more wheels, the size of one or more sections of one or more wheels and/or the quantity of pointers of one or more wheels is based on the amount wagered on one or more of the individually wagered on game plays.

In operation of these example embodiments, the gaming system enables the placement of an individual wager on one, more or each of the plurality of wheels. For each of the wagered on wheels (i.e., for each of the wagered on game plays), the gaming system concurrently or overlappingly activates such wheels to spin. Following the spin of such wheels, for each activated wheel, the gaming system determines and displays an award, if any, based on any symbols indicated by the pointer of that wheel.

In certain embodiments, in addition to utilizing one or more symbol generators in association with each of the concurrently or overlappingly played games, the gaming system disclosed herein employs a modifier generator to modify zero, one or more of the awards determined in association with zero, one or more of the concurrent or overlapping game plays. In certain embodiments, the modifier generator is centrally positioned relative to the plurality of concurrently or overlappingly played games. In one embodiment, in association with the concurrent or overlapping game plays, the gaming system causes the modifier generator to select zero, one or more of the concurrent or overlapping game plays. In this embodiment, the gaming system further causes the modifier generator to determine a modifier, such as a multiplier, a quantity of additional symbol generators or a triggering of a bonus event. Following the determination of a modifier, the gaming system applies the determined modifier to any award of any selected concurrent or overlapping game play.

For example, the gaming system employs a modifier generator including a pointer or indicator and positioned relative to the plurality of independent wheels of the plurality of games. In this example, the gaming system activates the modifier generator to: (i) randomly determine a modifier, and (ii) randomly select, by indicating with the pointer of the modifier generator, zero, one or more of the activated wheels. If the modifier generator randomly selects one of the wheels of one of the concurrently or overlappingly played games and if the pointer of that wheel indicates a symbol associated with an award, the gaming system modifies the award associated with the indicated symbol by the randomly determined modifier. On the other hand, if: (a) the modifier generator randomly selects one of the wheels of one of the concurrently or overlappingly played games and the pointer of that wheel does not indicate any symbols, or (b) the modifier generator randomly selects none of the wheels of any of the concurrently or overlappingly played games, the gaming system does not modify any awards by the randomly determined modifier. Such a modification of a randomly determined award of a randomly determined played game with a randomly determined modifier provides an increased level of volatility to the gaming system which certain players enjoy.

Additional features and advantages are described herein, and will be apparent from the following Detailed Description and the figures.

DETAILED DESCRIPTION

Overlapping Game Plays Employing Symbol Generators

In various embodiments, the gaming system disclosed herein includes a plurality of concurrent or overlapping game plays. Each concurrent or overlapping game play is associated with or otherwise configured to activate one or more symbol generators, such as one or more wheels. In these embodiments, following a determination of which of the games to concurrently or overlappingly play, such as following a placement of a wager on one or more of the games, the gaming system activates each symbol generator associated with each concurrent or overlapping game play. The gaming system causes each activated symbol generator to generate an outcome, such as an award value, a bonus game trigger or a losing outcome. In certain embodiments, the gaming system additionally selects one of the generated outcomes and modifies that generated outcome by a randomly determined modifier. In these embodiments, for each of the concurrently or overlappingly played games, the gaming system determines an award for that played game, wherein the award is based on the generated outcome or modified outcome of the activated symbol generator of that concurrently or overlappingly played game. Such a configuration of concurrently or overlappingly generating outcomes for a plurality of independently operated symbol generators utilized amongst a plurality of different concurrently or overlappingly played games increases the level of excitement and enjoyment for certain players by increasing the quantity of award opportunities for such players.

While certain of the embodiments described below are directed to playing the simultaneous, concurrent or overlapping games as simultaneous, concurrent or overlapping primary or base games, it should be appreciated that the present disclosure may additionally or alternatively be employed with a plurality of simultaneous, concurrent or overlapping secondary or bonus games. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
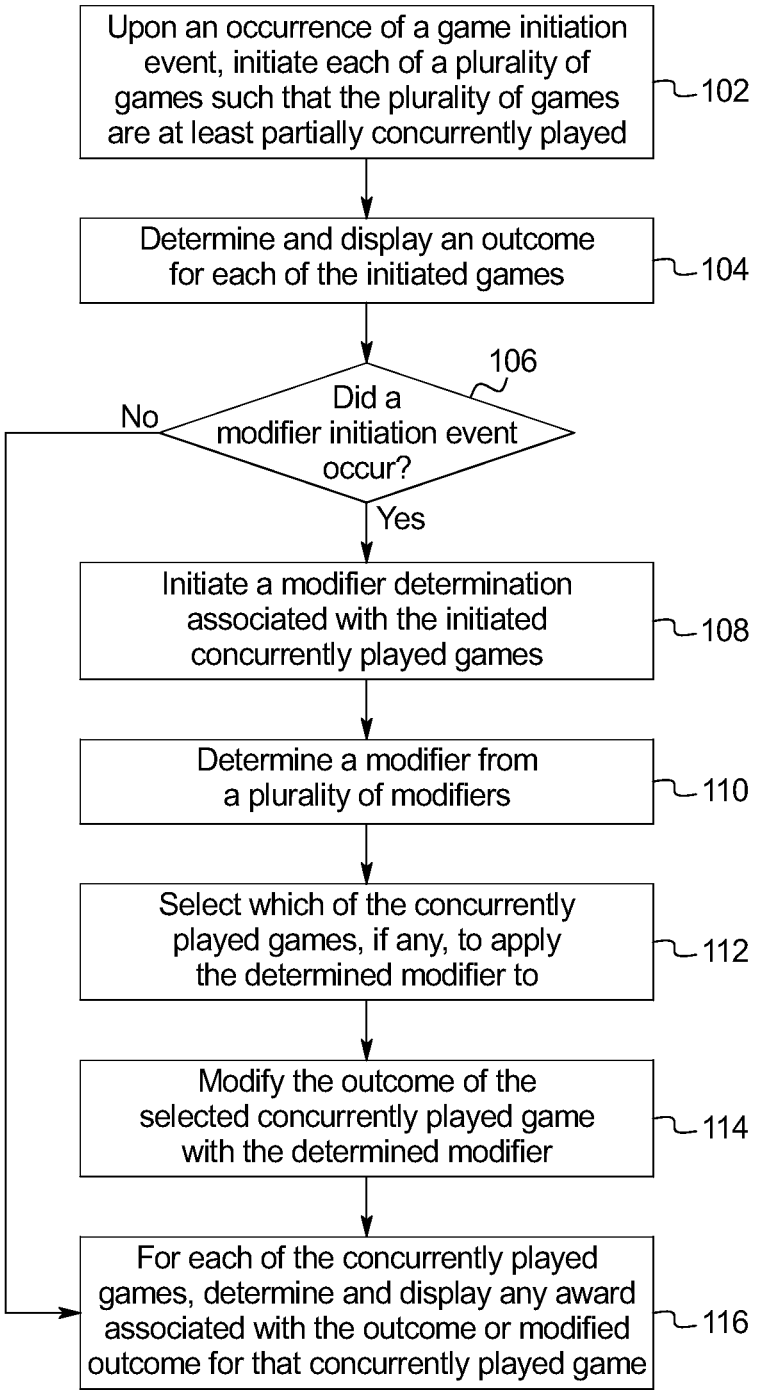
FIG. 1 is a flow chart an example process for operating a gaming system including a plurality of simultaneous or overlapping game plays and a modification of an outcome of zero, one or more of the game plays as disclosed herein.

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In various embodiments, upon an occurrence of a game initiation event, the gaming system initiates each of a plurality of games such that the plurality of games are at least partially concurrently played as indicated in block 102.

In certain embodiments, each of the plurality of games employ one or more symbol generators or outcome generators wherein the occurrence of the game initiation event is associated with the initiation or activation of one or more of the symbol generators. In these embodiments, each symbol generator is associated with a plurality of symbols available for the play of the game employing that symbol generator. In different embodiments, each symbol is associated with or otherwise representative of an award (e.g., an award value, an award modifier), a bonus game trigger and/or a game play feature or function.

Figure 2A:
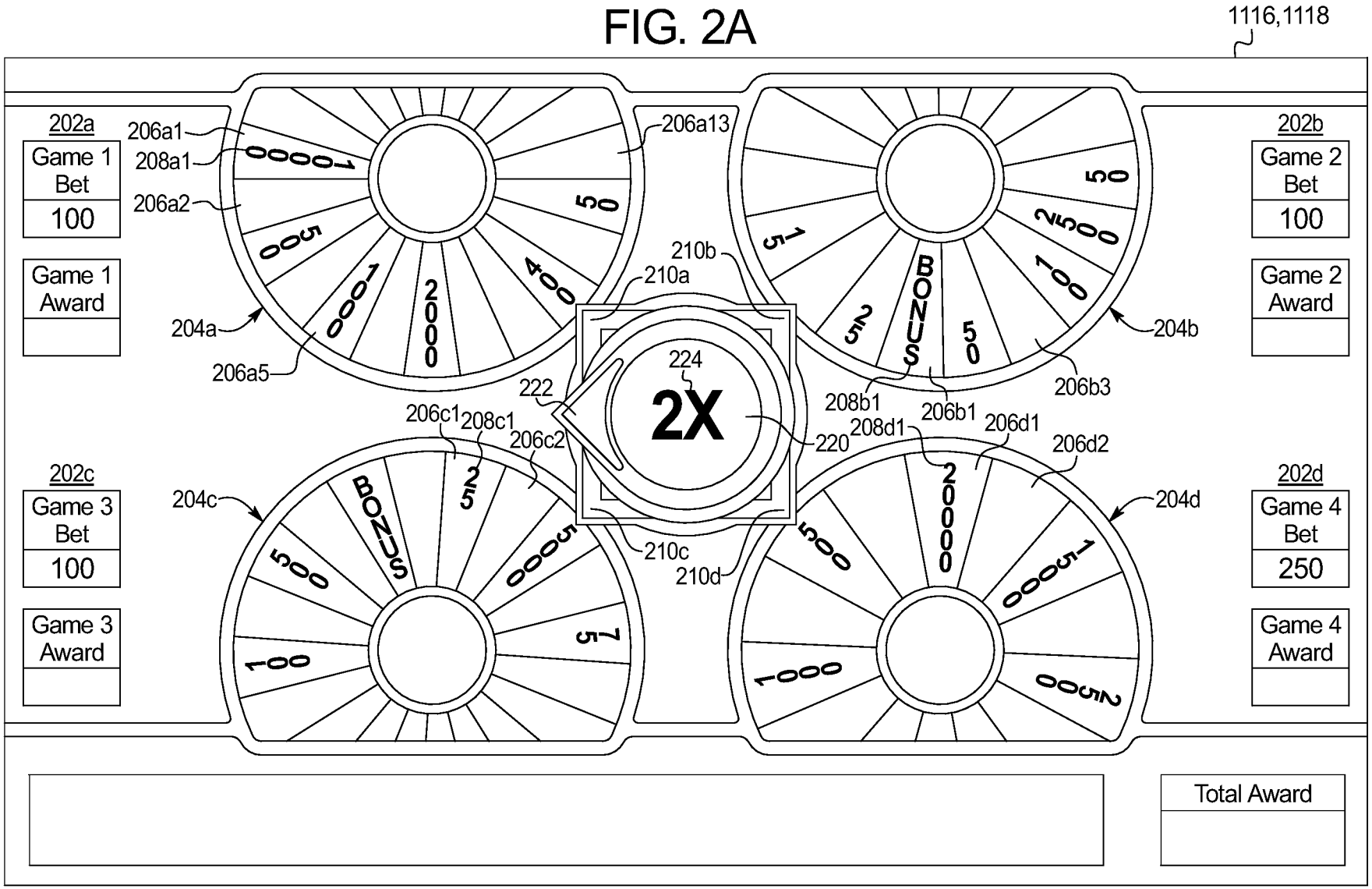
FIGS. 2A, 2B, 2C, and 2D are front views of one embodiment of the gaming system disclosed herein illustrating a play of a plurality of simultaneous or overlappingly game plays which each employ a symbol generator.

In one example embodiment, as seen in FIG. 2A, each of the games 202 is associated with a symbol generator displayed as a rotatable wheel 204. Each wheel 204 includes a plurality of sections or wedges 206. One or more of the sections or wedges of each wheel displays one of a plurality of symbols 208. Each wheel 204 is also associated with a pointer or indicator 210.

More specifically, as seen in FIG. 2A, the gaming system of this example embodiment includes a first game 202*a* associated with a first wheel 204*a*. The first wheel is associated with a first pointer 210*a*. The first wheel includes a first plurality of sections 206*a*1 to 206*a*22. Certain of the sections of the first wheel display symbols and certain of sections of the first wheel are blank and do not display any symbols. For example, section 206*a*1 of wheel 204*a* displays a symbol 208*a*1 representing an award of one-thousand credits and section 206*a*2 of wheel 204*a* is blank and does not display any symbols representing any awards (or represents an award have a value of zero).

As also seen in FIG. 2A, the gaming system of this example embodiment also includes a second game 202*b* associated with a second wheel 204*b*. The second wheel is associated with a second pointer 210*b*. The second wheel includes a second plurality of sections 206*b*1 to 206*b*18. Certain of the sections of the second wheel display symbols and certain of sections of the second wheel are blank and do not display any symbols. For example, section 206*b*1 of wheel 204*b* displays a symbol 208*b*1 representing a triggering of a bonus game an award of one-thousand credits and section 206*b*3 of wheel 204*b* is blank and does not display any symbols.

As also seen in FIG. 2A, the gaming system of this example embodiment also includes a third game 202*c* associated with a third wheel 204*c*. The third wheel is associated with a third pointer 210*c*. The third wheel includes a third plurality of sections 206*c*1 to 206*c*20. Certain of the sections of the third wheel display symbols and certain of sections of the third wheel are blank and do not display any symbols. For example, section 206*c*1 of wheel 204*c* displays a symbol 208*c*1 representing an award of twenty-five credits and section 206*c*2 of wheel 204*c* is blank and does not display any symbols.

As also seen in FIG. 2A, the gaming system of this example embodiment further includes a fourth game 202*d* associated with a fourth wheel 204*d*. The fourth wheel is associated with a fourth pointer 210*d*. The fourth wheel includes a fourth plurality of sections 206*d*1 to 206*d*14. Certain of the sections of the fourth wheel display symbols and certain of sections of the fourth wheel are blank and do not display any symbols. For example, section 206*d*1 of wheel 204*d* displays a symbol 208*d*1 representing an award of twenty-thousand credits and section 206*d*2 of wheel 204*d* is blank and does not display any symbols.

In certain embodiments, such as the example embodiment of FIG. 2A, two or more of the symbol generators employed in two or more of the plurality of games are different. In certain embodiments, two or more of the symbol generators employed in two or more of the plurality of games include different quantities of sections. In certain embodiments, two or more of the symbol generators employed in two or more of the plurality of games display different symbols. In certain embodiments, two or more of the symbol generators employed in two or more of the plurality of games are associated with different quantities of pointers. In certain embodiments, at least two or more of the symbol generators employed in at least two or more of the plurality of games have different game themes, and/or different game styles. In another embodiment, at least two or more of the symbol generators employed in at least two or more of the plurality of games utilize different paytables. In another embodiment, at least two or more of the symbol generators employed in at least two or more of the plurality of games are associated with different average expected payback percentages.

Figure 2B:
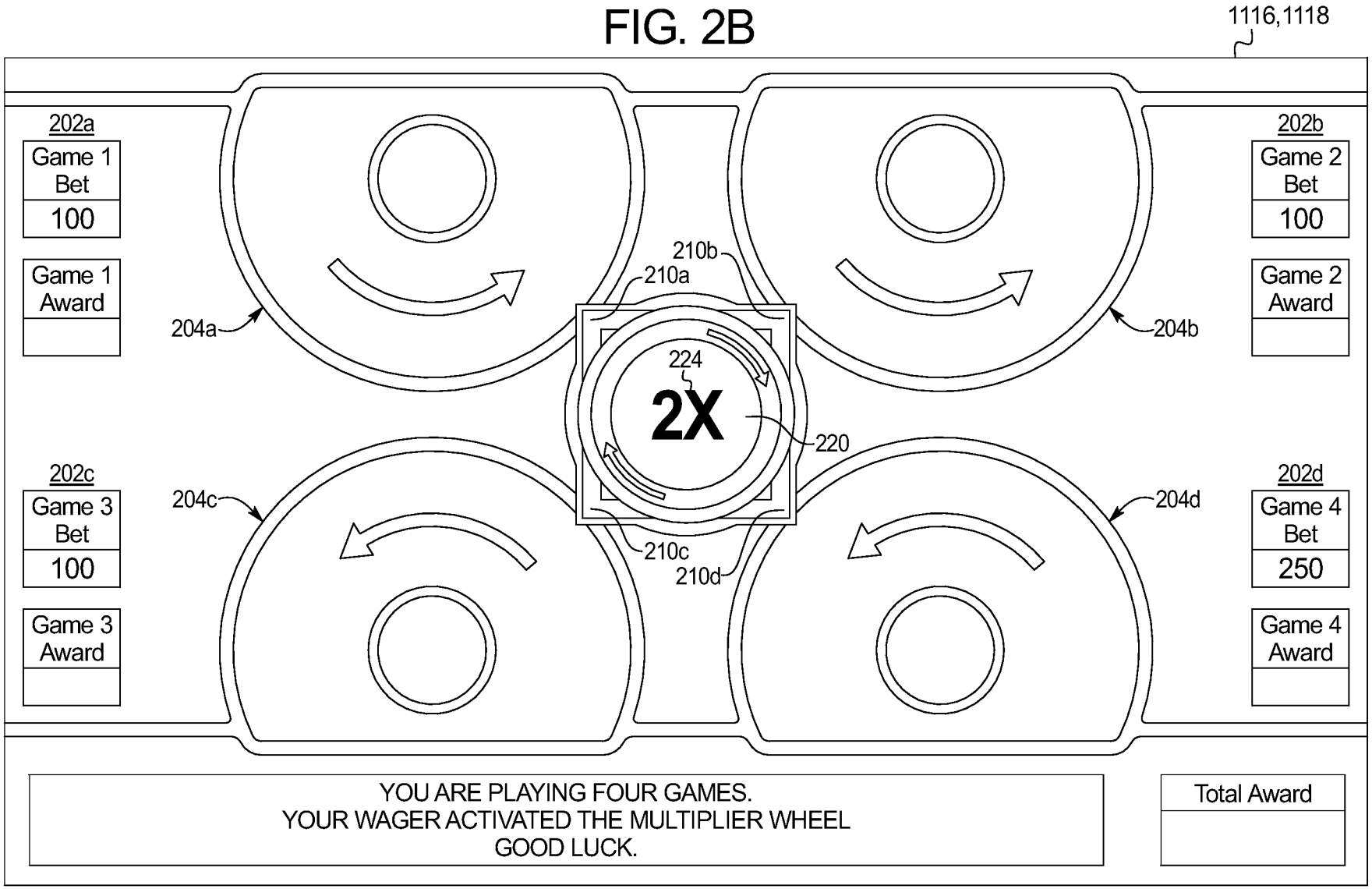

As seen in FIG. 2B, upon receiving a wager on each of the four available games (i.e., a game initiation event occurs for each of the four games), the gaming system initiates the spinning of each of the wheels associated with each of the wagered on games. In this example, the gaming system provides appropriate messages such as "YOU ARE PLAYING FOUR GAMES" and "GOOD LUCK" to the player visually, or through suitable audio or audiovisual displays.

Following the initiation of each of the plurality of concurrently or overlappingly played games, the gaming system determines and displays an outcome for each of the initiated games as indicated in block 104.

Figure 2C:
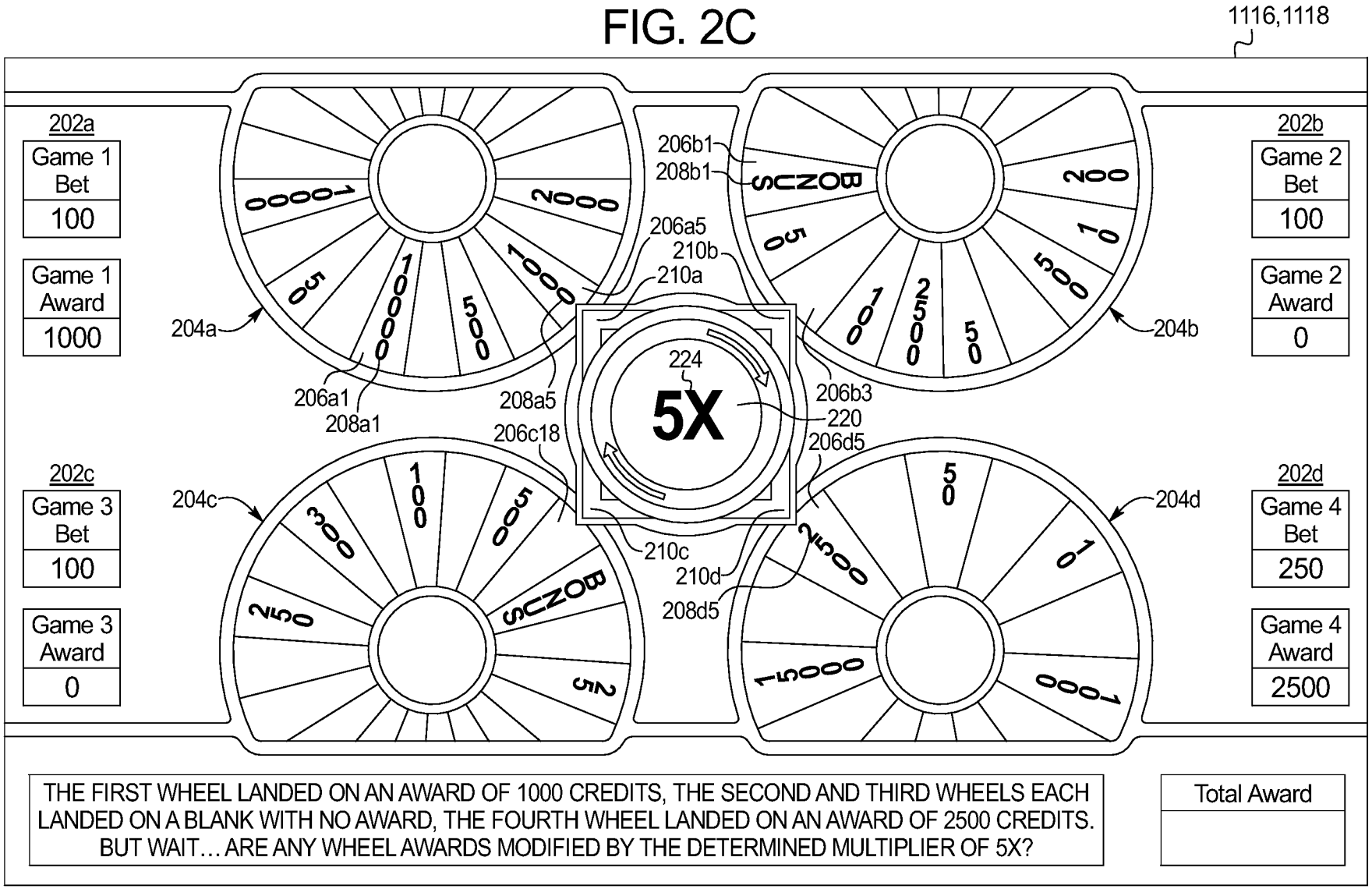

For example, after spinning and stopping each of the wheels of each of the wagered on games, for each of the activated wheels, the gaming system separately determines and displays which symbol, if any, is indicated by the pointer associated with that activated wheel. As seen in FIG. 2C, the gaming system spun each of the wagered on wheels such that: (i) the first pointer 210*a* associated with the first wheel 204*a* of the first game 202*a* indicated section 206*a*5 displaying symbol 208*a*5 associated with an award of one-thousand credits; (ii) the second pointer 210*b* associated with the second wheel 204*b* of the second game 202*b* indicated blank section 206*b*3 (i.e., a section not associated with any displayed symbol) associated with no award; (iii) the third pointer 210*c* associated with the third wheel 204*c* of the third game 202*c* indicated blank section 206*c*18 (i.e., a section not associated with any displayed symbol) associated with no awards; and (iv) the fourth pointer 210*d* associated with the fourth wheel 204*d* of the fourth game 202*d* indicated section 206*d*5 displaying symbol 208*d*5 associated with an award of two-thousand-five-hundred credits. As seen in this example embodiment, each pointer associated with each wheel is configured to indicate one and only one symbol. In this example, the gaming system provides appropriate messages such as "THE FIRST WHEEL LANDED ON AN AWARD OF 1000 CREDITS, THE SECOND AND THIRD WHEELS EACH LANDED ON A BLANK WITH NO AWARD, THE FOURTH WHEEL LANDED ON AN AWARD OF 2500 CREDITS" to the player visually, or through suitable audio or audiovisual displays.

In various embodiments, in addition to determining an occurrence of a game initiation event and initiating the play of one or more games, the gaming system determines if a modifier initiation event occurred as indicated in diamond 106 of FIG. 1.

In certain embodiments, the gaming system causes a modifier initiation event to occur upon receiving a wager, such as a side bet, to activate a generation of a modifier. In certain embodiments, the gaming system causes a modifier initiation event to occur independent of any displayed events associated with any plays of any games. In another embodiment, the gaming system causes a modifier initiation event to occur based on (or as a result of) one or more displayed events occurring in association with one or more plays of one or more games. In another embodiment, the gaming system tracks the occurrences of one or more suitable events occurring at or in association with one or more players and/or one or more games and determines, based on these tracked events, whether a modifier initiation event occurs. In another embodiment the gaming system defines one or more game play parameters, such as a wager amount or a maximum wager amount, wherein the gaming system determines whether a modifier initiation event occurs based on a player's tracked game play activity satisfying the defined parameter.

In these embodiments, if the gaming system determines that a modifier initiation event occurs, the gaming system initiates a modifier determination associated with the initiated plurality of concurrently or overlappingly played games as indicated in block 108.

In certain embodiments, a modifier determination event occurs employing a modifier generator to determine and display a modifier from a plurality of different modifiers. For example, as seen in FIG. 2A, a modifier generator 220, displayed as a rotatable wheel, is associated with each of the games 202. The modifier generator is associated with a pointer or indicator 222. The modifier generator is also associated with a plurality of available modifiers 224.

As further seen in FIG. 2B, upon receiving a side wager to activate the modifier generator (i.e., a modifier generator initiation event occurs), the gaming system initiates the spinning of the modifier generator. In this example, the gaming system provides appropriate messages such as "YOUR WAGER ACTIVATED THE MULTIPLIER WHEEL" to the player visually, or through suitable audio or audiovisual displays.

In addition to determining and displaying an outcome for each concurrently or overlappingly played game, if the gaming system initiated a modifier determination associated with the initiated concurrently played games, the gaming system determines a modifier from a plurality of modifiers as indicated in block 110 of FIG. 1.

For example, as further seen in FIG. 2C, since the placed wager activated the modifier generator, the gaming system randomly determines a modifier of a 5× multiplier 224 from the plurality of modifiers available for the activated modifier generator 220. In this example, the gaming system provides appropriate messages such as "BUT WAIT . . . ARE ANY WHEEL AWARDS MODIFIED BY THE DETERMINED MULTIPLIER OF 5×?" to the player visually, or through suitable audio or audiovisual displays.

Following the determination of a modifier, the gaming system selects which of the concurrently or overlappingly played games, if any, to apply the determined modifier to as indicated in block 112 of FIG. 1. The gaming system then proceeds with modifying the outcome of the selected concurrently played game with the determined modifier as indicated in block 114.

Following the modification of the outcome of the selected concurrently played game or if the gaming system determines that the modifier initiation event did not occur, for each of the concurrently played games, the gaming system determines and displays any award associated with the outcome or modified outcome for that concurrently played game as indicated in block 116.

Figure 2D:
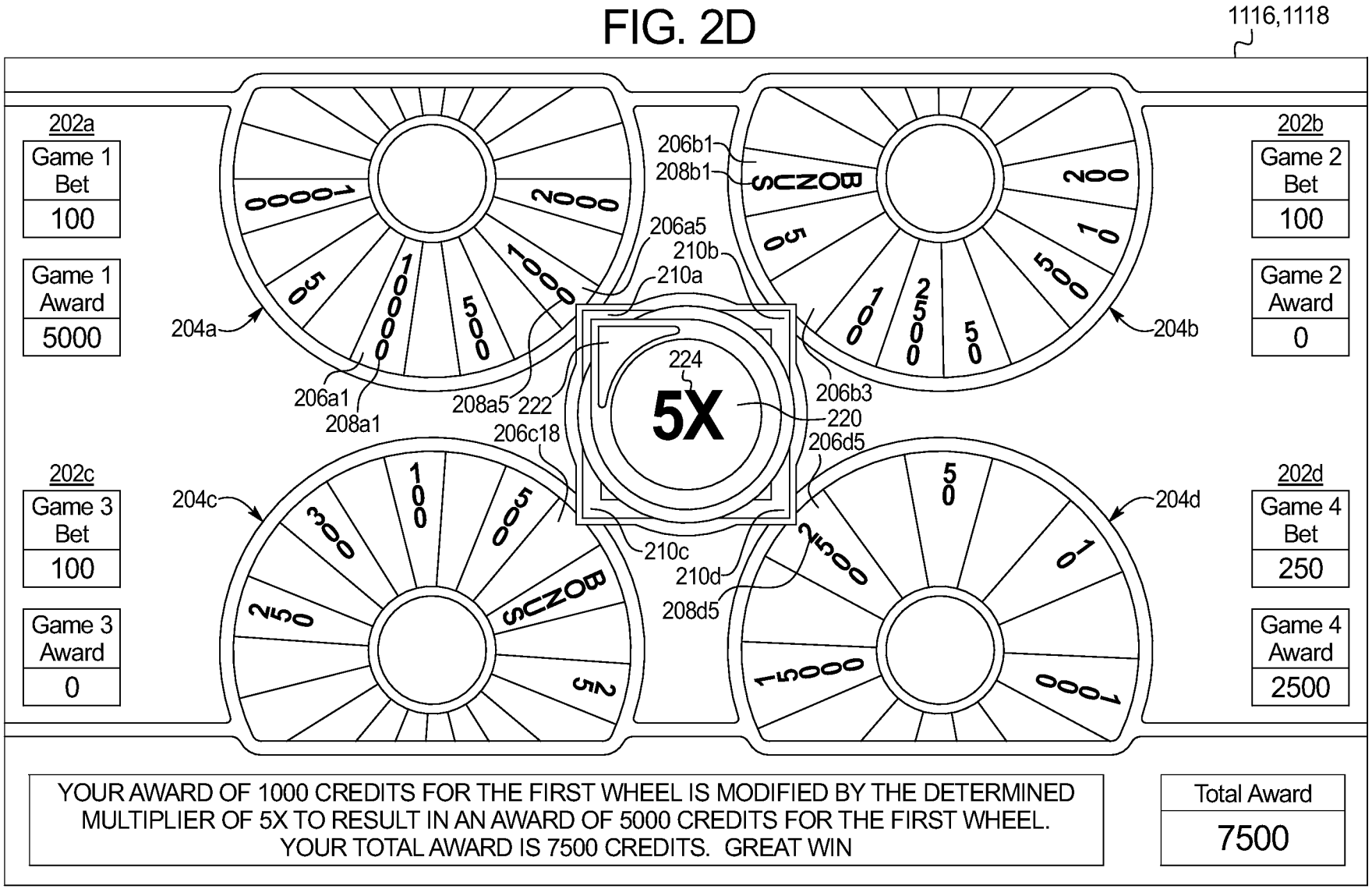

As seen in FIG. 2D, after spinning and stopping the modifier generator, the gaming system determines which symbol generator, if any, is indicated by the pointer associated with the modifier generator. As seen in FIG. 2D, the gaming system spun the modifier generator such that the modifier generator pointer 222 indicated the first wheel 204*a* of the first game 202*a*. That is, as seen in FIG. 2D, since the pointer of the modifier generator aligned with the first pointer 210*a* associated with the first wheel 204*a* of the first game 202*a*, the gaming system determined to apply the determined modifier of 5× to the award of one-thousand credits associated with the displayed symbol 208*a*5 of indicated section 206*a*5 of the first wheel 204*a* of the first game 202*a*. Accordingly, the gaming system multiplies the award of one-thousand credits associated with the displayed symbol 208*a*5 of indicated section 206*a*5 of the first wheel 204*a* of the first game 202*a* by the determined modifier of 5× to result in an award of five-thousand credits. As seen in this example embodiment, the gaming system selects at least one, but not all, of the wheels to modify any outcome of. In this example, the gaming system provides appropriate messages such as "YOUR AWARD OF 1000 CREDITS FOR THE FIRST WHEEL IS MODIFIED BY THE DETERMINED MULTIPLIER OF 5× TO RESULT IN AN AWARD OF 5000 CREDITS FOR THE FIRST WHEEL" and "YOUR TOTAL AWARD IS 7500 CREDITS. GREAT WIN" to the player visually, or through suitable audio or audiovisual displays.

It should be appreciated that in certain embodiments, such as the example embodiment of FIGS. 2A to 2D, the modifier generator is centrally positioned relative to the plurality of wheels. As further seen in the example embodiment of FIGS. 2A to 2D, the modifier generator is also positioned relative to the plurality of indicators of the plurality of wheels. Such a configuration provides a focus area for the player. This focus area includes a common area where both the gaming system displays any determined modifier and the gaming system determines if any indicators of any wheels point to any symbols. By aligning this focus area with the player's line of site, the gaming system of this embodiment provides an increased level of comfort and enjoyment for the player.

As described above, in certain embodiments wherein the games are primary games, a game initiation event occurs upon a player placing one or more wagers on one or more of a plurality of available games. In one embodiment, the gaming system enables the player to place the same wager amount on each of the games. In another embodiment, the gaming system enables the player to wager different wager amounts on two or more of the games. It should be appreciated that by enabling the player to select which games to play (via placing one or more wagers) and select which games not to play (via not placing any wagers), the gaming system enables the player to customize the game configuration associated with a plurality of simultaneous, concurrent or overlapping played games.

In another embodiment wherein the games are secondary games, the gaming system causes a game initiation event to occur independent of any displayed events associated with any plays of any games. In another embodiment wherein the games are secondary games, the gaming system causes a game initiation event to occur based on (or as a result of) one or more displayed events occurring in association with one or more plays of one or more games. In another embodiment wherein the games are secondary games, the gaming system tracks the occurrences of one or more suitable events occurring at or in association with one or more players and/or one or more games and determines, based on these tracked events, whether a game initiation event occurs. In another embodiment wherein the games are secondary games, the gaming system defines one or more game play parameters, such as a wager amount or a maximum wager amount, wherein the gaming system determines whether a game initiation event occurs based on a player's tracked game play activity satisfying the defined parameter.

In one embodiment, the gaming system initiates each of the plurality of games simultaneously, substantially simultaneously or overlappingly. In another embodiment, the gaming system initiates two or more of the plurality of games simultaneously or substantially simultaneously and initiates (but does not complete) two of more of the plurality of games sequentially or substantially sequentially. In another embodiment, the gaming system initiates (but does not complete) each of the plurality of games sequentially. In another embodiment, the gaming system initiates each of the plurality of games simultaneously, substantially simultaneously or overlappingly and completes each of the games sequentially.

In one embodiment, the gaming system employs one or more symbol generators and/or modifier generators in mechanical form. That is, in these embodiments, the gaming system includes one or more electromechanical devices, such as one or more rotatable wheels, configured to display the symbols and/or modifier as disclosed herein. In different embodiments, the gaming system includes different combinations of video generators and mechanical generators. In one example, the gaming system employs a plurality of video symbol generators and a mechanical modifier generator. In another example, the gaming system employs a plurality of mechanical symbol generators and a video modifier generator. In another example, the gaming system employs one or more video symbol generators, one or more mechanical symbol generators and a mechanical modifier generator. In another example, the gaming system employs one or more video symbol generators, one or more mechanical symbol generators and a video modifier generator.

In certain embodiments, as illustrated in FIGS. 2A to 2D, certain of the symbols of certain of the symbol generators are each associated with or otherwise representative of one of a plurality of different awards, such as one of a plurality of different award values.

As also illustrated in FIGS. 2A to 2D, certain of the symbols of certain of the symbol generators are each associated with or otherwise representative of a bonus game trigger. In these embodiments, if a pointer of an activated symbol generator indicates a symbol associated with a bonus game trigger, the gaming system proceeds to trigger one or more bonus games. In different embodiments, such bonus games include, but are not limited to one or more of:

i. a play of any suitable slot game;
ii. a play of any suitable free spins or free game activations;
iii. a play of any suitable wheel game;
iv. a play of any suitable card game;
v. a play of any suitable offer and acceptance game;
vi. a play of any suitable award ladder game;
vii. a play of any suitable puzzle-type game;
viii. a play of any suitable persistence game;
ix. a play of any suitable selection game;
x. a play of any suitable cascading symbols game;
xi. a play of any suitable ways to win game;
xii. a play of any suitable scatter pay game;
xiii. a play of any suitable coin-pusher game;
xiv. a play of any suitable elimination game;
xv. a play of any suitable stacked wilds game;
xvi. a play of any suitable trail game;
xvii. a play of any suitable bingo game;
xviii. a play of any suitable video scratch-off game;
xix. a play of any suitable pick-until-complete game;
xx. a play of any suitable shooting simulation game;
xxi. a play of any suitable racing game;
xxii. a play of any suitable promotional game;
xxiii. a play of any suitable high-low game;
xxiv. a play of any suitable lottery game;
xxv. a play of any suitable number selection game;
xxvi. a play of any suitable dice game;
xxvii. a play of any suitable skill game;
xxviii. a play of any suitable auction game;
xxix. a play of any suitable reverse-auction game;
xxx. a play of any suitable group game;
xxxi. a play of any suitable game in a service window;
xxxii. a play of any suitable game on a mobile device; and/or
xxxiii. a play of any suitable game disclosed herein.

In another embodiment, certain of the symbols of certain of the symbol generators are each associated with or otherwise representative of a game play feature. In these embodiments, if a pointer of an activated symbol generator indicates a symbol associated with a game play feature, the gaming system proceeds to activate that game play features. In different embodiments, such game play features include, but are not limited to one or more of:

i. a wild symbols feature;
ii. a book-end wild symbols feature (of a non-wheel based game);
iii. a stacked wild symbols feature;
iv. an expanding wild symbols feature;
v. a wild reel feature in a reel game;
vi. a retrigger symbol feature;
vii. an anti-terminator symbol feature;
viii. a locking reel feature in a reel game;
ix. a locking symbol position feature;
x. a modification of the value associated with one or more symbols of one or more sections of one or more symbol generators;
xi. a modification of an amount of credits of a credit balance;
xii. a modification of an amount of promotional credits;
xiii. a modification of a placed wager amount;
xiv. a modification of a wager amount available to be placed;
xv. a modification of a placed side wager amount;
xvi. a modification of a side wager amount available to be placed;

xvii. a modification of a rate of earning player tracking points;

xviii. a modification of a number of wagered on paylines in a reel game;

xix. a modification of a number of paylines available to be wagered on in a reel game;

xx. a modification of a wager placed on one or more paylines (or on one or more designated paylines) in a reel game;

xxi. a modification of a number of ways to win wagered on in a reel game;

xxii. a modification of a number of available ways to win to be wagered on in a reel game;

xxiii. a modification of a wager placed on one or more ways to win (or on one or more designated ways to win) in a reel game;

xxiv. a modification of a paytable utilized for a play of a game;

xxv. an application of a modifier, such as a multiplier or an additional quantity of credits, to one or more awards of a paytable utilized for a play of a game, xxvi. a modification of an average expected payback percentage of a play of a game;

xxvii. a modification of an average expected payout of a play of a game;

xxviii. a modification of one or more awards available;

xxix. a modification of a range of awards available;

xxx. a modification of a type of awards available;

xxxi. a modification of one or more progressive awards;

xxxii. a modification of which progressive awards are available to be won;

xxxiii. a modification of one or more modifiers, such as multipliers, available;

xxxiv. a modification of an activation of a reel (or a designated reel) in a reel game;

xxxv. a modification of an activation of a plurality of reels in a reel game;

xxxvi. a modification of a generated outcome (or a designated generated outcome);

xxxvii. a modification of a generated outcome (or a designated generated outcome) associated with an award over a designated value;

xxxviii. a modification of a generated outcome (or a designated generated outcome) on a designated payline in a reel game;

xxxix. a modification of a generated outcome (or a designated generated outcome) in a scatter configuration;

xl. a modification of a winning way to win (or a designated winning way to win) in a reel game;

xli. a modification of a designated symbol or symbol combination;

xlii. a modification of a generation of a designated symbol or symbol combination on a designated payline in a reel game;

xliii. a modification of a generation of a designated symbol or symbol combination in a scatter configuration;

xliv. a modification of a triggering event of a play of a secondary or bonus game;

xlv. a modification of an activation of a display (such as an award generator);

xlvi. a modification of a quantity of activations of a display (e.g., a modification of a quantity of spins of an award generator);

xlvii. a modification of a quantity of sections of a display (e.g., a modification of a quantity of sections of an award generator);

xlviii. a modification of one or more awards of a secondary or bonus display;

xlix. a modification of an activation of a community award generator;

l. a modification of a quantity of activations of a community award generator;

li. a modification of a quantity of sections of a community award generator;

lii. a modification of one or more awards of a community award generator;

liii. a modification of a generated outcome (or a designated generated outcome) in a secondary game;

liv. a modification of a quantity of picks in a selection game;

lv. a modification of a quantity of offers in an offer and acceptance game;

lvi. a modification of a quantity of moves in a trail game;

lvii. a modification of an amount of free spins provided;

lviii. a modification of a game terminating or ending condition;

lix. a modification of how one or more aspects of one or more games (e.g., colors, speeds, sound) are displayed to a player;

lx. a modification of access to different websites a player may access via a mobile device;

lxi. a modification of audio-visual content a player may access via a mobile device;

lxii. a modification of a player's avatar; and/or lxiii. a modification of any game play feature associated with any play of any game disclosed herein.

Figure 3:
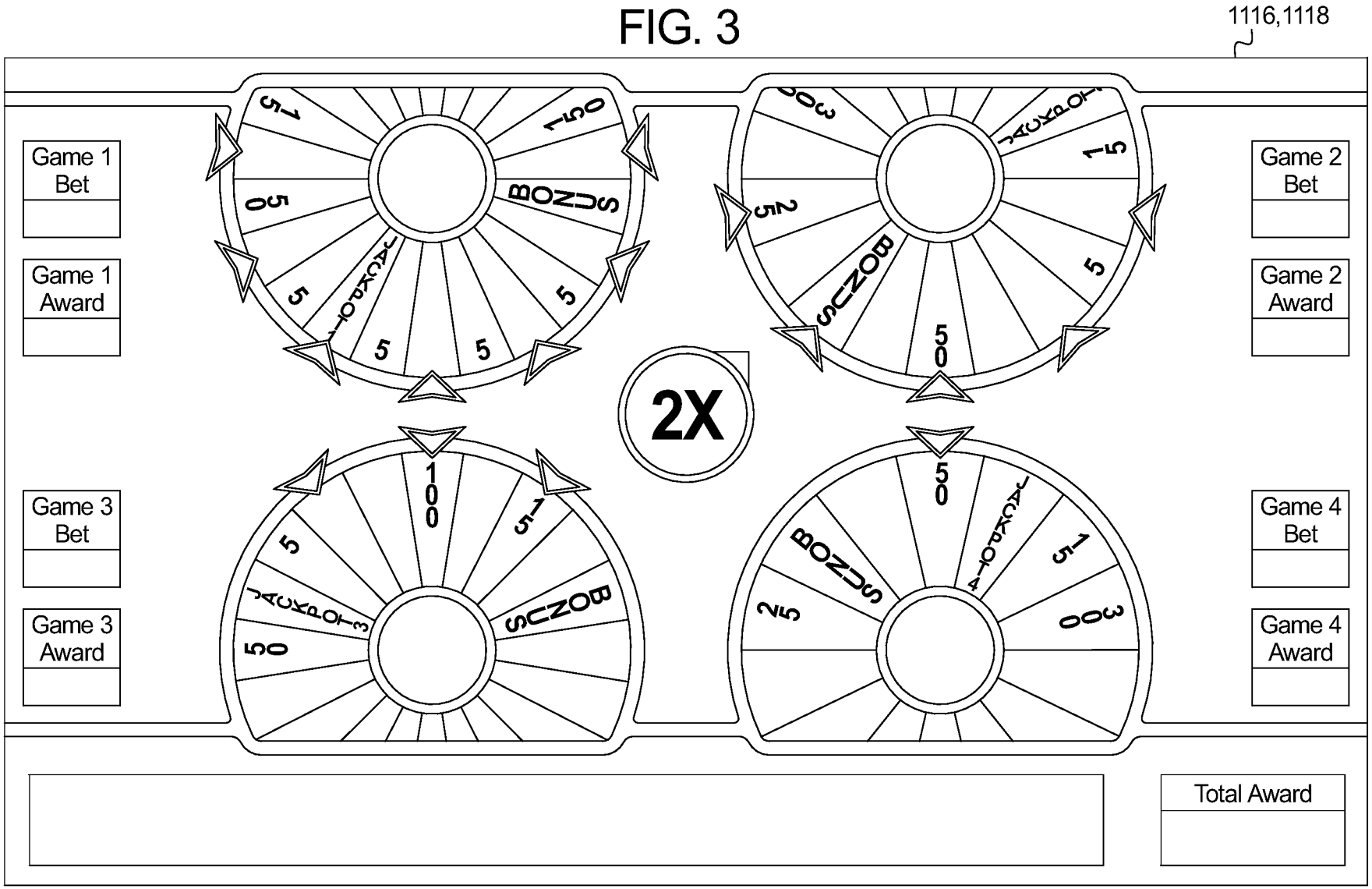
FIG. 3 is a front view of another embodiment of the gaming system disclosed herein illustrating a plurality of simultaneous or overlappingly game plays which each employ a symbol generator including a plurality of indicators.

In one embodiment, as illustrated in FIGS. 2A to 2D, each of the plurality of symbol generators are associated with an individual indicator or pointer. In another embodiment, zero, one or more of the symbol generators are each associated with a plurality of indicators or pointers. For example, as seen in FIG. 3: (i) a first symbol generator displayed as a first wheel is associated with seven pointers, (ii) a second symbol generator displayed as a second wheel is associated with five pointers, (iii) a third symbol generator displayed as a third wheel is associated with three pointers, and (iv) a fourth symbol generator displayed as a fourth wheel is associated with one pointer. As seen in this example, the modifier generator also includes a pointer configured to indicate one of the sections of one of the wheels and modify any outcome or award of that indicated section.

In one embodiment, as illustrated in FIGS. 2A to 2D, the modifier generator is associated with one indicator or pointer. In another embodiment, the modifier generator is associated with a plurality of indicators or pointers. In one such embodiment, the gaming system randomly selects a symbol generator for one or more of these plurality of pointers to indicate. In another such embodiment, the gaming system selects a symbol generator for one or more of these plurality of pointers to indicate based on a selection by a player. In another such embodiment, the gaming system selects a symbol generator for one or more of these plurality of pointers to indicate based on an outcome of one of the symbol generators. In another such embodiment, the gaming system selects a symbol generator for one or more of these plurality of pointers to indicate based on an amount of a wager placed.

In one embodiment, as illustrated in FIGS. 2A to 2D, the plurality of symbol generators are associated with a modifier generator. In another embodiment, the gaming system employs a plurality of modifier generators. In one such embodiment, each of the plurality of symbol generators are each associated with the plurality of modifier generators. In another such embodiment, a plurality of the symbol generators are each associated with an individual one of the modifier generators.

In one embodiment, while displaying each of the symbols of each of the sections of the symbol generators, the gaming system designates zero, one or more sections of zero, one or more symbol generators as active and designates zero, one or more sections of zero, one or more symbol generators as inactive. In this embodiment, the gaming system provides outcomes or awards associated with the indicated symbols of the active sections of the symbol generators.

In one embodiment, the gaming system arranges the plurality of symbol generators and the modifier generator as a plurality of concentric wheels. In this embodiment, the gaming system provides one or more awards based on the symbols of such concentric wheels lining up in a predefined configuration. In another embodiment, the gaming system arranges the plurality of symbol generators in a pyramid configuration. In this embodiment, the gaming system activates the symbol generators at the bottom of the pyramid and based on the outcomes indicated by these symbol generators, the gaming system activates the middle and/or top symbols generators of the pyramid configuration.

In one embodiment, the gaming system modifies zero, one or more outcomes of zero, one or more of the symbol generators and/or zero, one or more of the modifier generators. In one such embodiment, the gaming system nudges the modifier determined by modifier generator. In another such embodiment, the gaming system nudges the position of one or more of the stopped symbol generators to indicate another section of such symbol generators. In another such embodiment, the gaming system nudges the position of the stopped modifier generator to indicate another symbol generator (or not indicate any symbol generators).

In different embodiments, one or more awards provided in association with one or more game plays include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In another embodiment, the gaming system causes at least one display device of at least one electronic gaming machine to display the plurality of symbol generators and the modifier generator of the plurality of games. In another embodiment, in addition or in alternative to each electronic gaming machine displaying the plurality of games, the gaming system causes one or more community or overhead display devices to display part or all of the plurality of symbol generators and the modifier generator of the plurality of games to one or more other players or bystanders either at a gaming establishment or viewing over a network, such as the internet. In another embodiment, in addition or in alternative to each electronic gaming machine displaying the plurality of symbol generators and the modifier generator of the plurality of games, the gaming system causes one or more internet sites to each display the plurality of symbol generators and the modifier generator of the plurality of games such that a player is enabled to log on from a personal web browser. In another such embodiment, the gaming system enables the player to play one or more games on one device while viewing the plurality of symbol generators and the modifier generator of the plurality of games from another device, such as a desktop or laptop computer.

In different embodiments, a game initiation event and/or a modifier initiation event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, the gaming system does not provide any apparent reasons to the players for an occurrence of a game initiation event or a modifier initiation event. In these embodiments, such determinations are not triggered by an event in a primary game or based specifically on any of the plays of any primary games. That is, these events occur without any explanation or alternatively with simple explanations.

In one such embodiment, a game initiation event and/or a modifier initiation event occurs based on an amount of coin-in. In this embodiment, the gaming system determines if an amount of coin-in wagered reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a game initiation event and/or a modifier initiation event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a game initiation event and/or a modifier initiation event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a game initiation event and/or a modifier initiation event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a game initiation event and/or a modifier initiation event occurs based on a predefined variable reaching a defined parameter threshold. For example, when the 500,000$^{th}$ player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a game initiation event and/or a modifier initiation event occurs based on a quantity of games played. In this embodiment, a quantity of games played is set for when one or more of such events or conditions will occur. In one embodiment, such a set quantity of games played is based on historic data.

In different embodiments, a game initiation event and/or a modifier initiation event occurs based on time. In this embodiment, a time is set for when one or more of such events or conditions will occur. In one embodiment, such a set time is based on historic data.

In different embodiments, a game initiation event and/or a modifier initiation event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a game initiation event and/or a modifier initiation event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a game initiation event and/or a modifier initiation event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a game initiation event and/or a modifier initiation event to occur may be implemented in accordance with the gaming system and method disclosed herein. It should be appreciated that one or more of the above-described triggers pertaining to a game initiation event and/or a modifier initiation event occurring may be combined in one or more different embodiments.

Alternative Embodiments

It should be appreciated that in different embodiments, one or more of:

i. which games or types of games a player is enabled to simultaneously or concurrently play;
ii. a quantity of games a player is enabled to simultaneously or concurrently play (e.g., a quantity of symbol generators simultaneously or concurrently activated);
iii. how the plurality of simultaneously or concurrently played games are displayed;
iv. a quantity of sections of one or more symbol generators;
v. a size of one or more sections of one or more symbol generators;
vi. which symbols are displayed on which sections of which symbol generators;
vii. which awards are associated with which symbols of the symbol generators;
viii. which game features are associated with which symbols of the symbol generators;
ix. a quantity of pointers associated with one or more symbol generators;
x. a quantity of activated pointers associated with one or more symbol generators;
xi. which pointers are associated with which symbol generators;

xii. if a game initiation event occurs;

xiii. a quantity of activations of zero, one or more symbol generators;

xiv. which outcome to determine for each concurrently played game (e.g., which outcome to display for each activated symbol generator);

xv. if a modifier initiation event occurs;

xvi. a quantity of modifier generators to employ;

xvii. which modifiers are available to be selected for which modifier generators;

xviii. a quantity of activations of zero, one or more modifier generators;

xix. a modifier determined to be applied to zero, one or more outcomes of zero, one or more concurrently played games;

xx. a quantity of pointers associated with one or more modifier generators;

xxi. a quantity of activated pointers associated with one or more modifier generators;

xxii. which symbol generator, if any, to indicate with the pointer of the modifier generator;

xxiii. one or more paytables utilized for a play of one or more of the games;

xxiv. one or more average expected payout percentages of a play of one or more of the games;

xxv. one or more awards available for a play of one or more of the games;

xxvi. one or more ranges of awards available for a play of one or more of the games;

xxvii. one or more types of awards available for a play of one or more of the games; and/or xxviii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
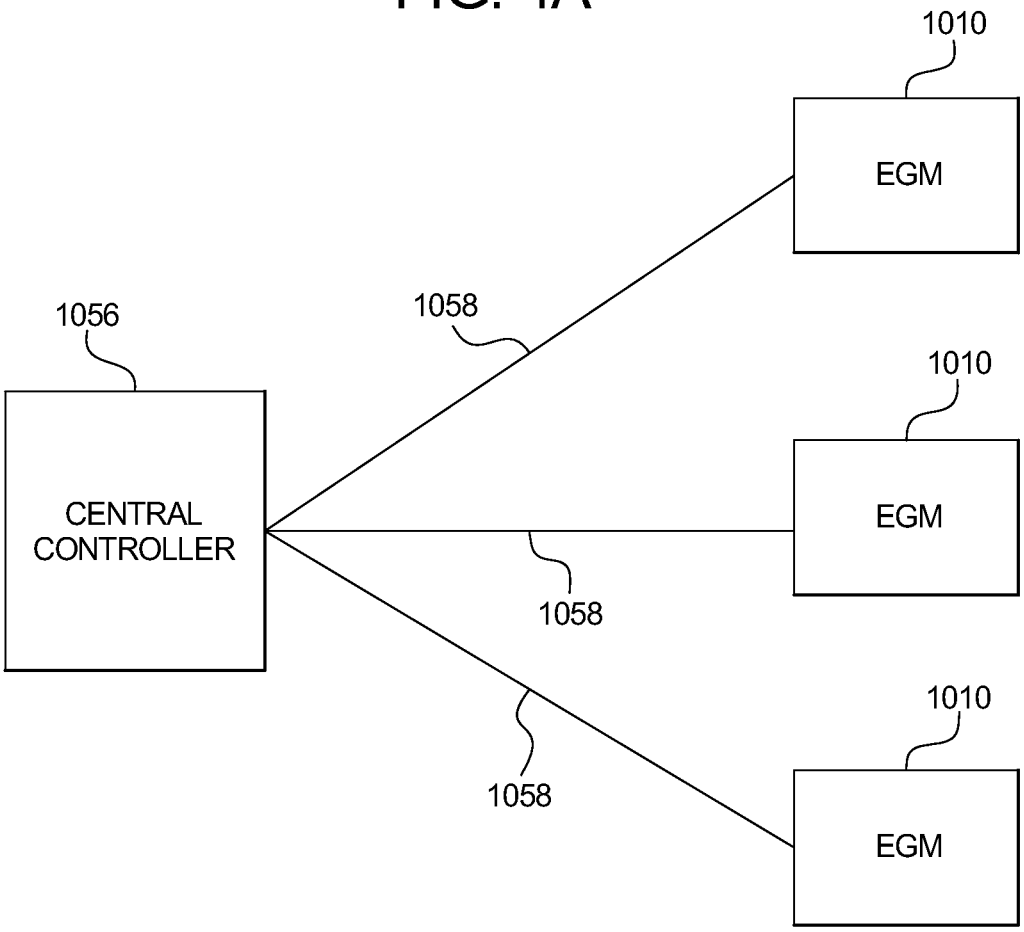
FIG. 4A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
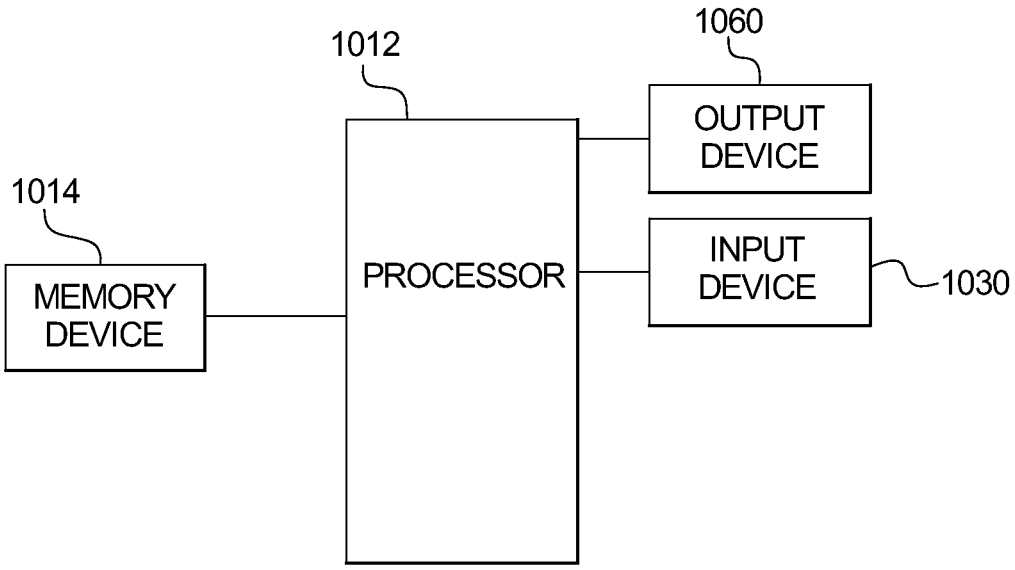
FIG. 4B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
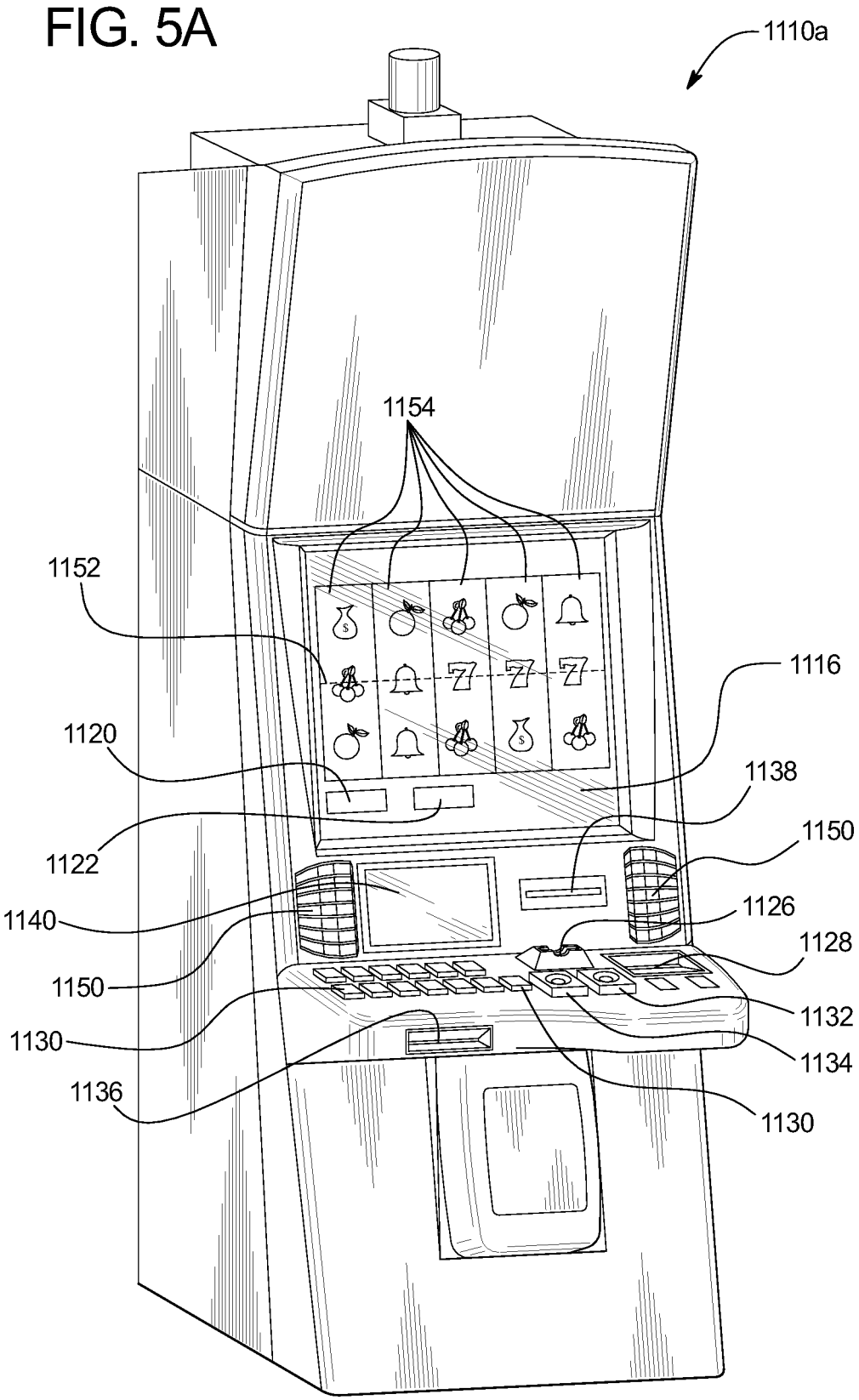
FIGS. 5A and 5B are perspective views of example alternative embodiments of the gaming system disclosed herein.
Figure 5B:
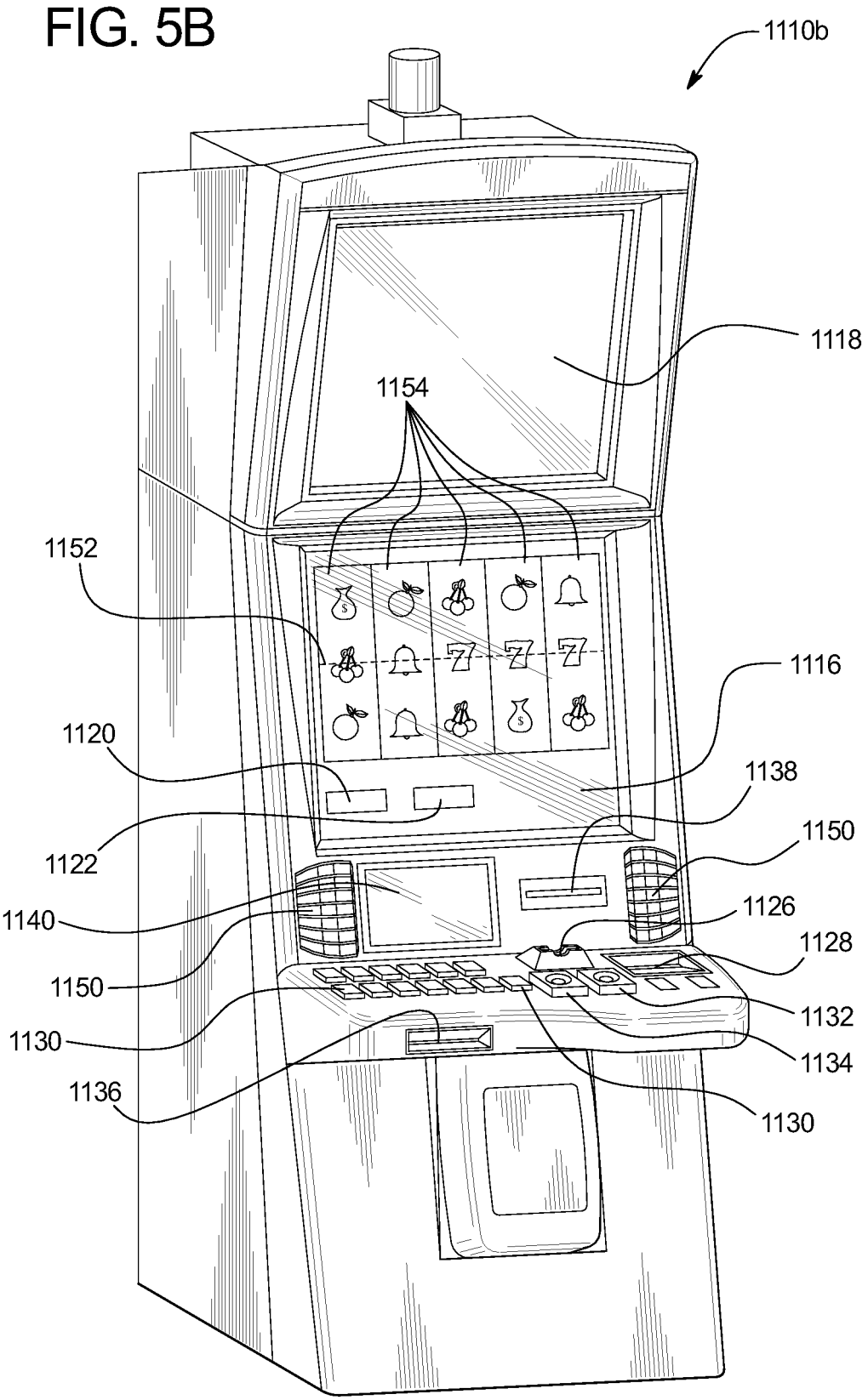

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B each include a payline 1152 and a plurality of reels 1156. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game initiation event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to:

cause the at least one display device to display:

a plurality of wheels, each wheel including a plurality of sections having a plurality of displayed symbols, and each wheel associated with at least one indicator, wherein the plurality of wheels include at least:

a first wheel including a first plurality of sections having a first plurality of symbols and a predetermined association with at least a first indicator, and a second wheel including a second plurality of sections having a second plurality of symbols and a predetermination association with at least a second, different indicator, and a modifier generator including a plurality of modifiers and associated with at least one modifier generator indicator which is distinct from any of the indicators associated with any of the wheels, receive, via the at least one input device, a placement of a wager amount on at least one of the plurality of wheels, wherein different received wager amounts are associated with different quantities of the plurality of wheels, and for each wagered on wheel:

cause the at least one display device to display each of the at least one indicator associated with said wagered on wheel indicating a randomly determined section, determine any award associated with any symbol of the indicated section, and cause the at least one display device to display any determined award associated with the symbol of the indicated section, and responsive to a modifier generator initiation event occurring:

randomly determine, independent of any player selection after the placement of the wager amount, one of the plurality of modifiers, and following an activation of the modifier generator, for each modifier generator indicator:

determine if that modifier generator indicator indicates any randomly determined sections of any of the wheels, responsive to that modifier generator indicator not indicating any randomly determined sections of any of the wheels, not modifying, based on the randomly determined modifier, any determined awards associated with any symbols of any indicated sections of any of the wheels, and responsive to that modifier generator indicator indicating a randomly determined section of one of the wheels:

modify, based on the randomly determined modifier, any determined award associated with the symbol of the indicated section of said wheel, and cause the at least one display device to display the modified award.

2. The gaming system of claim 1, wherein the first plurality of sections of the first wheel and the second plurality of sections of the second wheel include different quantities of sections.

3. The gaming system of claim 1, wherein for at least one of the wheels, a quantity of the sections of said wheel is greater than a quantity of the displayed symbols of said wheel.

4. The gaming system of claim 1, wherein at least two of the wheels each have a predetermination association with a different quantity of indicators.

5. The gaming system of claim 1, wherein at least one of the determined awards of at least one of the wagered on wheels is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

6. The gaming system of claim 1, which includes an acceptor, wherein when executed by the at least one processor, the plurality of instructions cause the at least one processor to: responsive to a physical item being received via the acceptor, establish a credit balance based, at least in part, on a monetary value associated with the received physical item, and responsive to a cashout input being received, cause an initiation of any payout associated with the credit balance.

7. The gaming system of claim 1, wherein the at least one display device comprises a display device of a mobile device.

8. The gaming system of claim 7, wherein the at least one processor communicates with the mobile device over a wireless data network.

9. A gaming system server comprising:

at least one processor; and at least one memory device which stores a plurality of instructions, which when executed by the at least one processor, cause the at least one processor to:

cause a display, by at least one display device, of:

a plurality of wheels, each wheel including a plurality of sections having a plurality of displayed symbols, and each wheel associated with at least one indicator, wherein the plurality of wheels include at least:

a first wheel including a first plurality of sections having a first plurality of symbols and a predetermination association with at least a first indicator, and a second wheel including a second plurality of sections having a second plurality of symbols and a predetermination association with at least a second, different indicator, and a modifier generator including a plurality of modifiers and associated with at least one modifier generator indicator which is distinct from any of the indicators associated with any of the wheels, receive data associated with a placement of a wager amount on at least one of the plurality of wheels, wherein different received wager amounts are associated with different quantities of the plurality of wheels, and for each wagered on wheel:

cause a display, by the at least one display device, of each of the at least one indicator associated with said wagered on wheel indicating a randomly determined section, determine any award associated with any symbol of the indicated section, and cause a display, by the at least one display device, of any determined award associated with the symbol of the indicated section, and responsive to a modifier generator initiation event occurring:

randomly determine, independent of any player selection after the placement of the wager amount, one of the plurality of modifiers, and following an activation of the modifier generator, for each modifier generator indicator:

determine if that modifier generator indicator indicates any randomly determined sections of any of the wheels, responsive to that modifier generator indicator not indicating any randomly determined sections of any of the wheels, not modifying, based on the randomly determined modifier, any determined awards associated with any symbols of any indicated sections of any of the wheels, and responsive to that modifier generator indicator indicating a randomly determined section of one of the wheels:

modify, based on the randomly determined modifier, any determined award associated with the symbol of the indicated section of said wheel, and cause a display, by the at least one display device, of the modified award.

10. The gaming system server of claim 9, wherein the first plurality of sections of the first wheel and the second plurality of sections of the second wheel include different quantities of sections.

11. The gaming system server of claim 9, wherein for at least one of the wheels, a quantity of the sections of said wheel is greater than a quantity of the displayed symbols of said wheel.

12. The gaming system server of claim 9, wherein at least two of the wheels each have a predetermination association with a different quantity of indicators.

13. The gaming system server of claim 9, wherein at least one of the determined awards of at least one of the wagered on wheels is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

14. The gaming system server of claim 9, which transmits and receives data over a data network.

15. The gaming system server of claim 14, wherein the data network is an internet.

16. The gaming system server of claim 9, wherein the placed wager amount causes a decrease of a credit balance which is increasable via an acceptor of a physical item associated with a monetary value.

17. The gaming system server of claim 9, wherein the at least one display device comprises a display device of a mobile device.

18. The gaming system server of claim 17, wherein the at least one processor communicates with the mobile device over a wireless data network.

19. A method of operating a gaming system, said method comprising:

causing a display, by a display device, of:

a plurality of wheels, each wheel including a plurality of sections having a plurality of displayed symbols, and each wheel associated with at least one indicator, wherein the plurality of wheels include at least:

a first wheel including a first plurality of sections having a first plurality of symbols and a predetermination association with at least a first indicator, and a second wheel including a second plurality of sections having a second plurality of symbols and a predetermination association with at least a second, different indicator, and a modifier generator including a plurality of modifiers and associated with at least one modifier generator indicator which is distinct from any of the indicators associated with any of the wheels, receiving a placement of a wager amount on at least one of the plurality of wheels, wherein different received wager amounts are associated with different quantities of the plurality of wheels, for each wagered on wheel:

causing a display, by the display device, of each of the at least one indicator associated with said wagered on wheel indicating a randomly determined section, determining, by at least one processor, any award associated with any symbol of the indicated section, and causing a display, by the display device, of any determined award associated with the symbol of the indicated section, and responsive to an occurrence of a modifier generator initiation event:

randomly determining, by the at least one processor and independent of any player selection after the placement of the wager amount, one of the plurality of modifiers, and following an activation of the modifier generator, for each modifier generator indicator:

determining, by the at least one processor, if that modifier generator indicator indicates any randomly determined sections of any of the wheels, responsive to that modifier generator indicator not indicating any randomly determined sections of any of the wheels, not modifying, based on the randomly determined modifier, any determined awards associated with any symbols of any indicated sections of any of the wheels, and responsive to that modifier generator indicator indicating a randomly determined section of one of the wheels:

modifying, by the at least one processor and based on the randomly determined modifier, any determined award associated with the symbol of the indicated section of said wheel, and causing a display, by the display device, of the modified award.

20. The method of claim 19, wherein the first plurality of sections of the first wheel and the second plurality of sections of the second wheel include different quantities of sections.

21. The method of claim 19, wherein for at least one of the wheels, a quantity of the sections of said wheel is greater than a quantity of the displayed symbols of said wheel.

22. The method of claim 19, wherein at least two of the wheels each have a predetermination association with a different quantity of indicators.

23. The method of claim 19, wherein at least one of the determined awards of at least one of the wagered on wheels is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

24. The method of claim 19, which is executed through a data network.

25. The method of claim 24, wherein the data network is an internet.

26. The method of claim 19, wherein the received wager amount causes a decrease of a credit balance which is increasable via an acceptor of a physical item associated with a monetary value.

27. The method of claim 19, wherein the display device comprises a display device of a mobile device.

28. The method of claim 27, wherein the at least one processor communicates with the mobile device over a wireless data network.

* * * * *